US010570680B2

(12) United States Patent
Andreychuk et al.

(10) Patent No.: US 10,570,680 B2
(45) **Date of Patent: *Feb. 25, 2020**

(54) MOBILE COILED TUBING REEL UNIT, RIG AND ARRANGEMENTS THEREOF

(71) Applicant: Coil Solutions, Inc., Calgary (CA)

(72) Inventors: Mark Andreychuk, Calgary (CA); Allan Joseph Pleskie, Chestermere Lake (CA); Matthew Joseph Gotch, Calgary (CA); Gary Russell Callander, Calgary (CA)

(73) Assignee: Coil Solutions, Inc, Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/672,436

(22) Filed: Aug. 9, 2017

(65) Prior Publication Data

US 2017/0335640 A1 Nov. 23, 2017

Related U.S. Application Data

(63) Continuation of application No. 15/228,773, filed on Aug. 4, 2016, now Pat. No. 9,759,022, which is a continuation of application No. 13/931,761, filed on Jun. 28, 2013, now Pat. No. 9,464,493.

(60) Provisional application No. 61/666,297, filed on Jun. 29, 2012.

(51) Int. Cl.

| | |
|---|---|
| ***E21B 19/22*** | (2006.01) |
| ***E21B 19/00*** | (2006.01) |
| ***E21B 7/02*** | (2006.01) |
| ***E21B 15/00*** | (2006.01) |

(Continued)

(52) U.S. Cl.

CPC ..... *E21B 19/22* (2013.01); *E21B 7/02* (2013.01); *E21B 7/023* (2013.01); *E21B 15/00* (2013.01); *E21B 17/20* (2013.01); *E21B 19/00* (2013.01); *E21B 19/08* (2013.01)

(58) Field of Classification Search

CPC . E21B 7/02; E21B 7/022; E21B 7/023; E21B 7/026; E21B 19/22

See application file for complete search history.

(56) References Cited

U.S. PATENT DOCUMENTS 6,431,286 B1 * 8/2002 Andreychuk ..... E21B 19/22 166/384

8,671,626 B1 * 3/2014 Marty ..... E21B 15/04 175/85

(Continued)

*Primary Examiner* — Kristyn A Hall

*Assistant Examiner* — Tara E Schimpf

(74) *Attorney, Agent, or Firm* — Ramey and Schwaller, LLP; William P. Ramey

(57) ABSTRACT

A system is provided for injecting coiled tubing (CT) into and out of a wellbore. In embodiments, separate injector and reel units are provided releasing constraints on CT size and length. The injector unit is fit with an extendible mast for handling larger bottom hole assemblies and fit with a rotating gooseneck for accepting CT from alternate arrangements of the reel unit. The mast is reinforced to resist CT loading. The capacity of the reel is maximized for the reel unit transport envelope. The reel is rotated using an offset drive engaging a bounding reel flange, such as engaging drive and bull gears. A generally radial displacement of the drive from the reel permits replacement of the entire reel.

14 Claims, 22 Drawing Sheets

(51) Int. Cl.
*E21B 17/20* (2006.01)
*E21B 19/08* (2006.01)

(56) References Cited

U.S. PATENT DOCUMENTS

2007/0074460 A1* 4/2007 Belik ..... E21B 7/023
52/40
2007/0209791 A1* 9/2007 Havinga ..... E21B 7/02
166/77.2
2013/0175048 A1* 7/2013 Goode ..... E21B 19/08
166/379
2014/0097027 A1* 4/2014 Marica ..... E21B 7/023
175/220

* cited by examiner

MOBILE COILED TUBING REEL UNIT, RIG AND ARRANGEMENTS THEREOF

CROSS-RELATED APPLICATIONS

This application is a continuation of application Ser. No. 15/228,773 filed Aug. 4, 2016, which is a continuation of application Ser. No. 13/931,761 filed Jun. 28, 2013, which claims the benefits under 35 U.S.C. 119(e) of the U.S. Provisional Application Ser. No. 61/666,297, filed Jun. 29, 2012, all of which are incorporated fully herein by reference.

FIELD

Embodiments described herein relate to a system for injecting coiled tubing into and out of a wellbore and supplying coiled tubing thereto. More particularly the system relates to versatile arrangements of a mobile injector unit having a reorientable gooseneck and separate mobile reel unit.

BACKGROUND

Systems for injecting coiled tubing (CT) into and out of a well bore are well known, typically used for hydraulic fracturing operations. The majority of the known systems comprise an all-in-one trailer for supporting and positioning a coiled tubing injector supported in a mast, a coiled tubing reel and a control cab. The mast is erectable at a back end of the trailer over a wellhead, the reel being centrally located and the control cab located over the pin end of the trailer. The injector includes a gooseneck for guiding the coiled tubing into the injector from the reel. Drawworks, crown sheaves and cables position the injector and gooseneck in the mast at injection elevation. During running in and tripping out, CT is spooled on and off of the reel under control of an operator in the control cab. The CT can remain stabbed into the injector even during shipping.

Downhole operations demand longer and longer bottom hole assemblies (BHA's) which require longer/taller lubricators and require positioning of the injectors at a greater overall height or elevation above the wellhead. Further, as wellbores become longer and longer for maximizing access to deeper hydrocarbon payzones, the longer lengths of CT require larger reels, resulting in combined reel and trailer weights being greater than weight allowances and negatively affect dimensions of CT permitted for conventional transport.

More frequently, current systems are limited in regards to maximum injector elevation due to constraints upon limitations on the transportable length of the mast and the weight of the rig. Thus, a length of CT that can be carried with the rig is limited to accommodate transport or road allowances.

When masts are fit with deployable extensions, operations or length are compromised due to the difficulty in creating a continuous track through the extension, upon which the injector is to be raised and lowered.

Thus, there is interest in apparatus and methods for increased mast height for handling longer BHA's and for maximizing reel capacity while retaining the ability for meeting conventional road allowance requirements.

SUMMARY

Embodiments described herein relate to a system for injecting coiled tubing into and out of a wellbore. Generally, a system and particular arrangements of apparatus are provided for injecting coiled tubing (CT) into and out of a wellbore to overcome limitations found in prior art systems.

Embodiments of a mobile injector unit are fit with a mast configuration that enables higher elevations and therefore can accommodate taller lubricators. Further, the injector unit is freed of the reel and associated weight. Instead, in embodiments a separate reel unit is provided, dedicated to reel transport for maximal reel capacity. In embodiments, a reel drive is provided for managing larger than conventional reel movement and facilitating spent reel removal and replacement reel installation.

Further, embodiments of the mobile injector unit and mobile reel unit enable flexibility of the layout on site, either guiding CT over the injector unit in a drive end orientation somewhat reminiscent to prior art all-in-one units, or alternatively in a back end orientation, with the CT being guided from the wellhead side of the injector.

According to one broad aspect, a system is provided for conveying coiled tubing (CT) into and out of a wellbore comprising a first mobile unit having a first mobile frame having drive end, a back end and a mast supported on the back end adjacent the wellbore, the mast pivotable between a transport position and an erect position; a CT injector moveable along the mast; a gooseneck; and a rotatable support between the gooseneck and the injector. A second mobile unit is also provided having a second mobile frame having a CT reel and a reel drive. Accordingly, when the second mobile unit is located at the drive end of the first mobile unit, the gooseneck is rotatable on the rotating support to the drive end to receive CT therefrom. Further, when the second mobile unit is located at the back end of the first mobile unit, the gooseneck is rotatable on the rotating support to the back end to receive CT therefrom.

The above system can be used in a method for injecting coiled tubing (CT) in and out of a wellbore, comprising positioning a CT injector unit with a back end adjacent a wellbore, an opposing drive end and a longitudinal axis, the CT injector unit having a mast supporting at least a CT injector and a gooseneck; positioning a CT reel unit generally in line with the longitudinal axis of the CT injector unit; rotating the gooseneck to receive CT from the CT reel unit; supplying CT from the CT reel unit to the CT injector unit; and resisting loading applied to the mast.

In another aspect, a folding mast for a coiled tubing (CT) injector is provided. The folding mast is supported from a frame and comprises a pair of parallel mast posts. A carriage is supported between the mast posts and adapted for moving the CT injector along the mast, each mast post further comprising: a first mast section for support from the frame, a second mast section, and an extension pivot, pivotally connecting the second mast section to the first mast section. A crown connects the second mast sections of each mast post.

Further, in another aspect, A rotating gooseneck can be provided comprising a rotatable support between the gooseneck and the CT injector. The gooseneck is foldable having a proximal segment of the gooseneck connected to the rotatable support, and a distal segment connected to the proximal segment and pivotable between an extended position for forming an arcuate CT guide, and a folded position. When the gooseneck is in the folded position, the folded gooseneck has effective turning radius that enables rotation clear of the mast.

In another aspect, a mobile unit for transporting a reel of coil tubing (CT) can be provided comprising a mobile frame having front and rear wheels and a transport envelope having a height and width substantially that of road transport allowances. A CT reel is fit intermediate the longitudinal extent of the frame between the front and rear wheels and comprising a spool having an axle on a reel axis and bounding flanges, the width between the bounding flange being substantially that of the mobile frame, and the diametral extent being substantially that of the height of the transport envelope; and a drive is provided offset radially from the reel axis and engaging at least one of the bounding flange for rotation thereof.

A drive system for a mobile reel unit can further comprise a CT reel comprising a spool having an axle on a reel axis and bounding flanges; and a drive offset radially from the reel axis and engaging at least one of the bounding flange for rotation thereof.

BRIEF DESCRIPTION OF THE DRAWINGS

FIGS. 5AS and 5AT illustrate the gooseneck having the arcuate guide section extended in a drive end orientation;

FIG. 7A shows the mast folded and in the transport position on the rig;

FIG. 7B shows the base portion of the the mast being raised;

FIG. 7C shows the base portion of the mast in the erect and folded position;

FIGS. 7D, 7E and 7F are three stages of the rotation of the distal extension end of the folding mast being raised to the extended and erected position; and FIG. 7G shows the mast fully extended the lock claw of one portion engaging the lock pin of the other portion;

FIGS. 12AT and 12AS are top and side views respectively of a CT reel ready for replacement;

DESCRIPTION

A system is disclosed for injecting coiled tubing (CT) into and out of a wellbore.

Figure 1A:
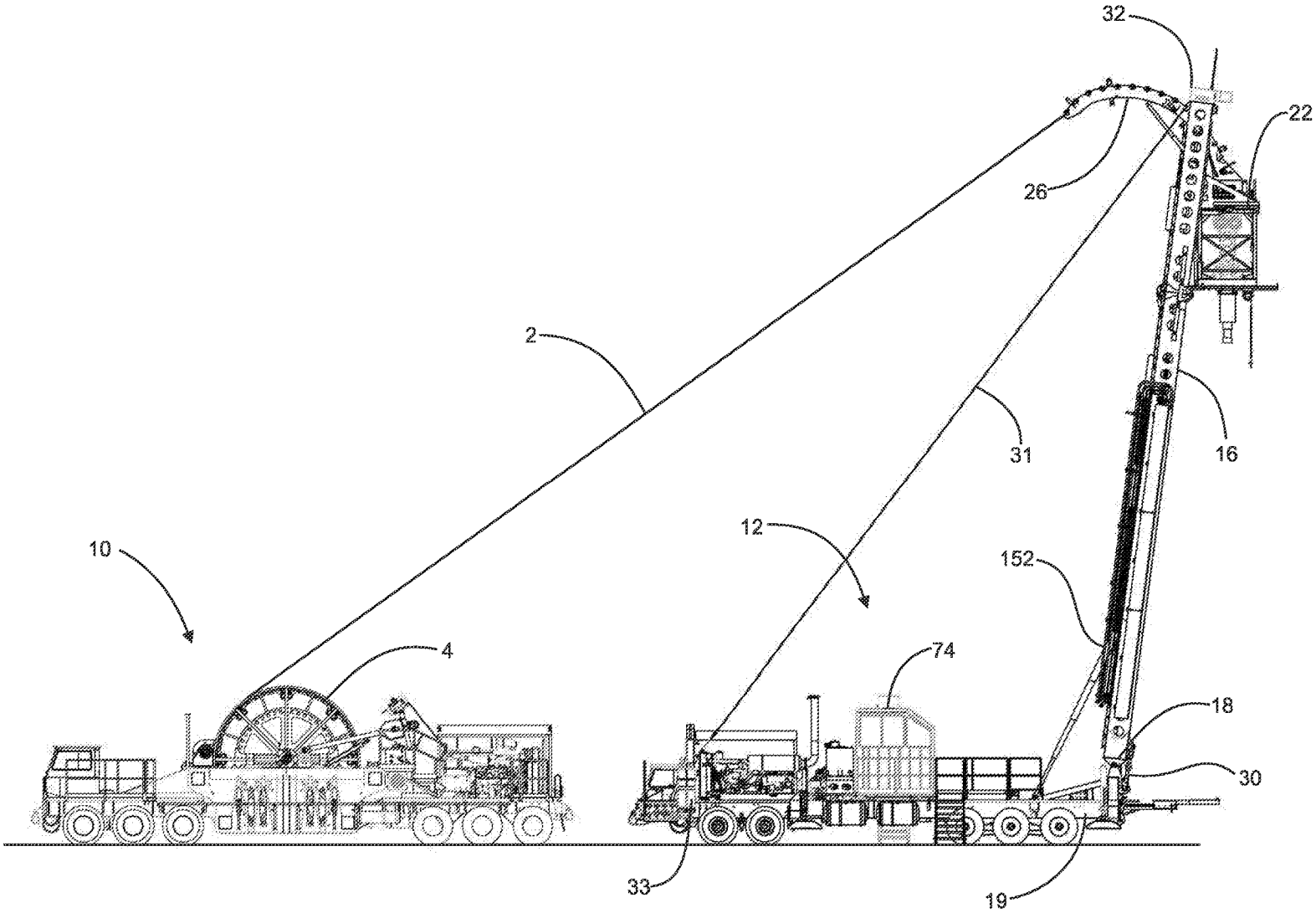
FIG. 1A is a schematic of an embodiment of the system for injecting coiled tubing into and out of a wellbore where a coiled tubing reel unit is aligned of the drive end of a coiled tubing injector unit on the same side of a well.
Figure 1B:
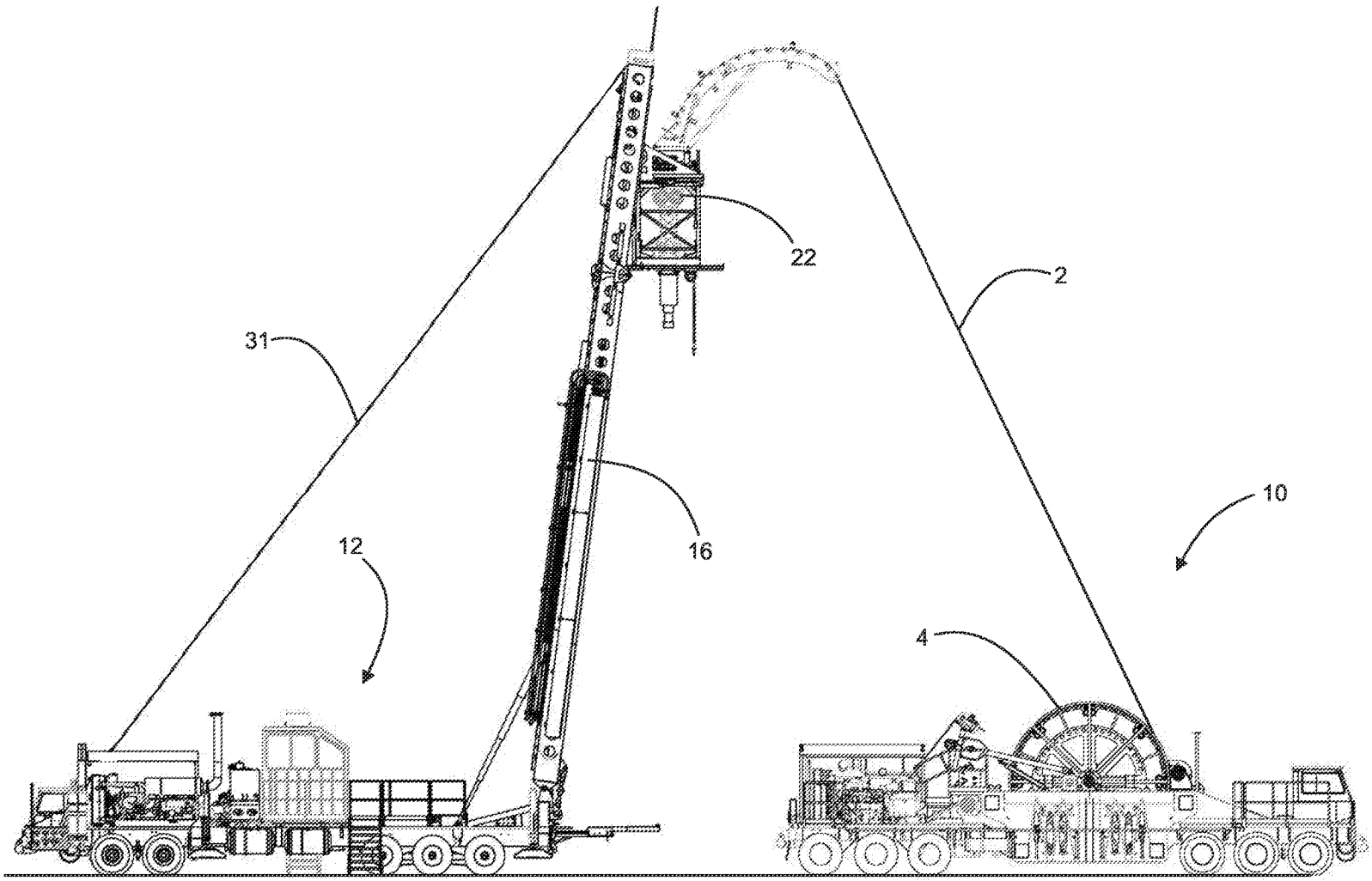
FIG. 1B is a schematic of an embodiment of the system for injecting coiled tubing into and out of a wellbore where a coiled tubing reel unit is spaced on a back end of the coiled tubing injector unit on opposing sides of a well.

In FIGS. 1A and 1B, embodiments of the system comprise two separate mobile units used for injecting coiled tubing 2 (CT) into and out of a wellbore (wellbore not shown). A first coiled tubing injector unit 12 is provided on a first mobile frame 13, absent a CT reel, in favour of a second mobile CT reel unit 10, on a second mobile frame 200, having a reel 4. In embodiments described herein, the CT reel unit 10 can accommodate a large CT reel 4, permitting larger and longer CT for use in extended length downhole operations. Accordingly, embodiments of the invention are adaptable for deploying a greater variety of CT having various diameters, lengths and weights.

Further, and as illustrated by the opposing arrangements of the units 12,10 of FIGS. 1A and 1B, as a result of various physical space constraints that may be present at various well sites, embodiments are adaptable to permit the CT 2 to be injected from either a front end or drive end 33 or a back end 19 of the CT injector unit 12.

Referring to FIG. 1A, in an embodiment, the CT injector unit 12 comprise a mast 16, pivotably supported at a mast pivot 18 at a wellhead or back end 19 of the unit 12. An injector 22, having a gooseneck 26, is supported on the mast 16 and is moveable therealong for injecting CT 2 into a wellbore. The injector 22 overhangs the back end 19 and, in part, counteracts the loading of the CT 2 being feed thereto. As disclosed in greater detail below, a mast support 30, such as a tensile load-resisting member, connecting the mast 16 to the injector unit 12, resists or counteracts load from any overturning moments imposed by the delivery of CT 2 to the injector 22. Further, an optional tensile member, such as a guy wire 31, connects a top end 32 of the mast 16 with a front or drive end 33 of the CT injector unit 12 for providing additional stability to the mast 16 when erect. As shown, the CT reel unit (CTRU) 10 comprises the CT reel 4 having CT 2 wound thereabout for supplying CT 2 for injecting into the wellbore. As shown, the CT 2 is guided into the injector 22 by the gooseneck 26 supported on the injector 22.

More specifically, as shown in FIG. 1A, in one embodiment, the CTRU 10 is positioned at the back end 33 of the CT injector unit 12. The gooseneck 26 is oriented to face the CTRU 10 in a first, drive end orientation.

In an alternate embodiment, and as shown in FIG. 1B, the CTRU 10 is positioned in a back end orientation at the back end 19 of the CT injector unit 12, supplying CT from the injector side of the mast 16. In this orientation, the injector unit 12 and reel unit 10 are on opposing sides of the wellhead. In this embodiment the gooseneck 26 is pivoted to face away from CT injector unit 12. The weight of the injector 22 compounds the loading of the supplied CT 2. The guy wire 31 resists or counteracts the overturning load on the mast 16.

A person of ordinary skill in the art would understand that, unless otherwise detailed, both the CTRU 10 and the CT injector unit 12 would comprise various support equipment typically found on conventional apparatus.

Figure 2A:
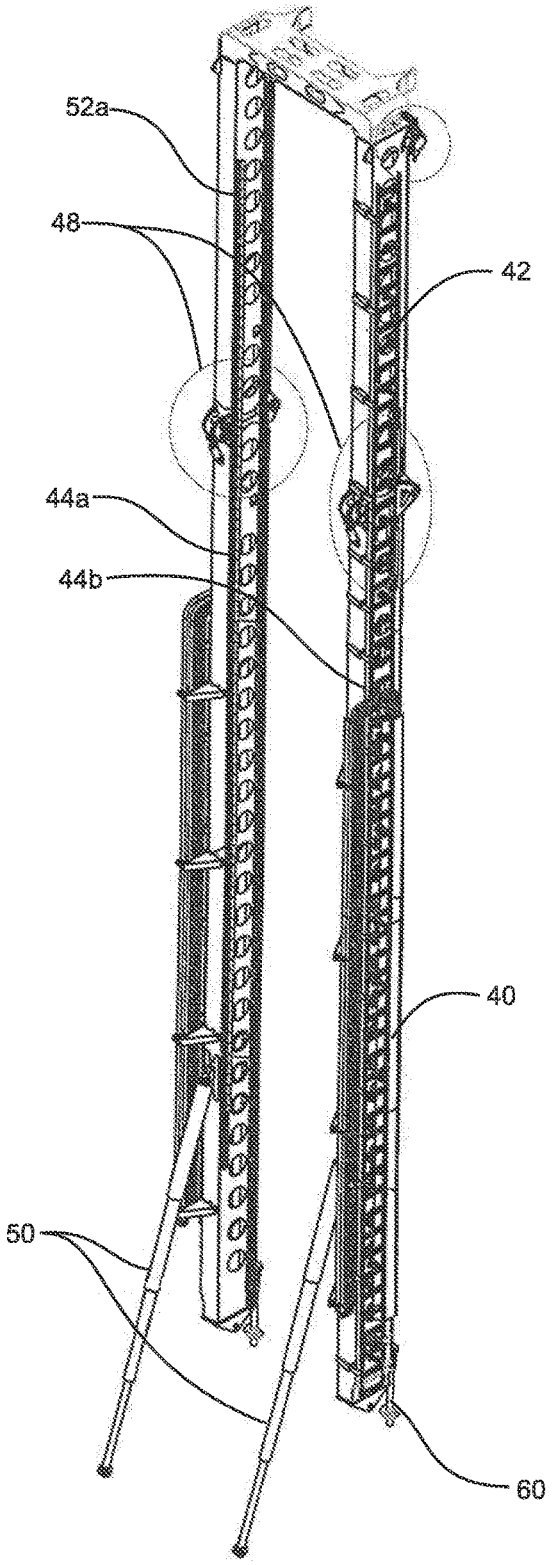
FIG. 2A is a perspective view of a drive end view of an erect mast.
Figure 2B:
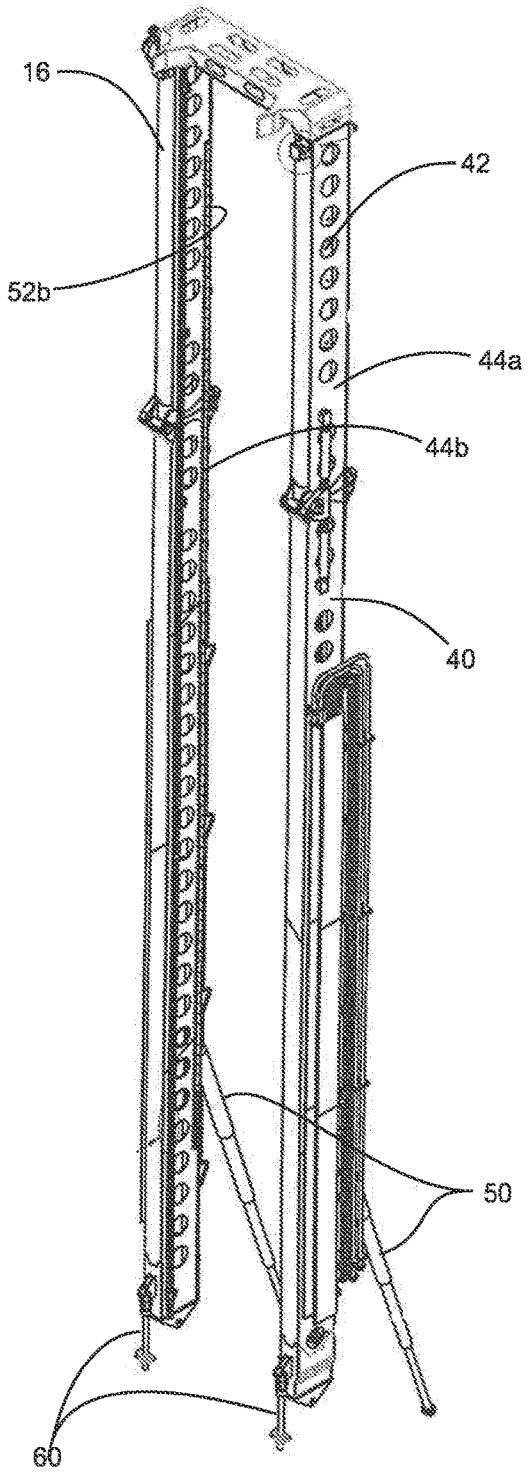
FIG. 2B is a perspective view of a back end view of the mast of FIG. 2A.

With reference to FIGS. 2A and 2B, the mast 16 is mounted for pivotal movement on the back end 19 of the CT injector unit 12. The mast 16 comprises a pair of spaced, longitudinally extending and parallel mast posts 44*a*, 44*b*.

Each post 44*a*,44*b* has a base or first mast section 40 and an extension or second mast section 42. A first or proximal end of the first mast section 40 is pivotally mounted at mast pivot 18 to the CT injector unit 12 while an opposing second or distal end is pivotally connected at the extension pivot 48 to the second mast section 42. The mast posts 44*a*,44*b* are connected at crown 76. The base and extension portions 40, 42 are secured in the extended position using a mast lock 46.

Figure 2C:
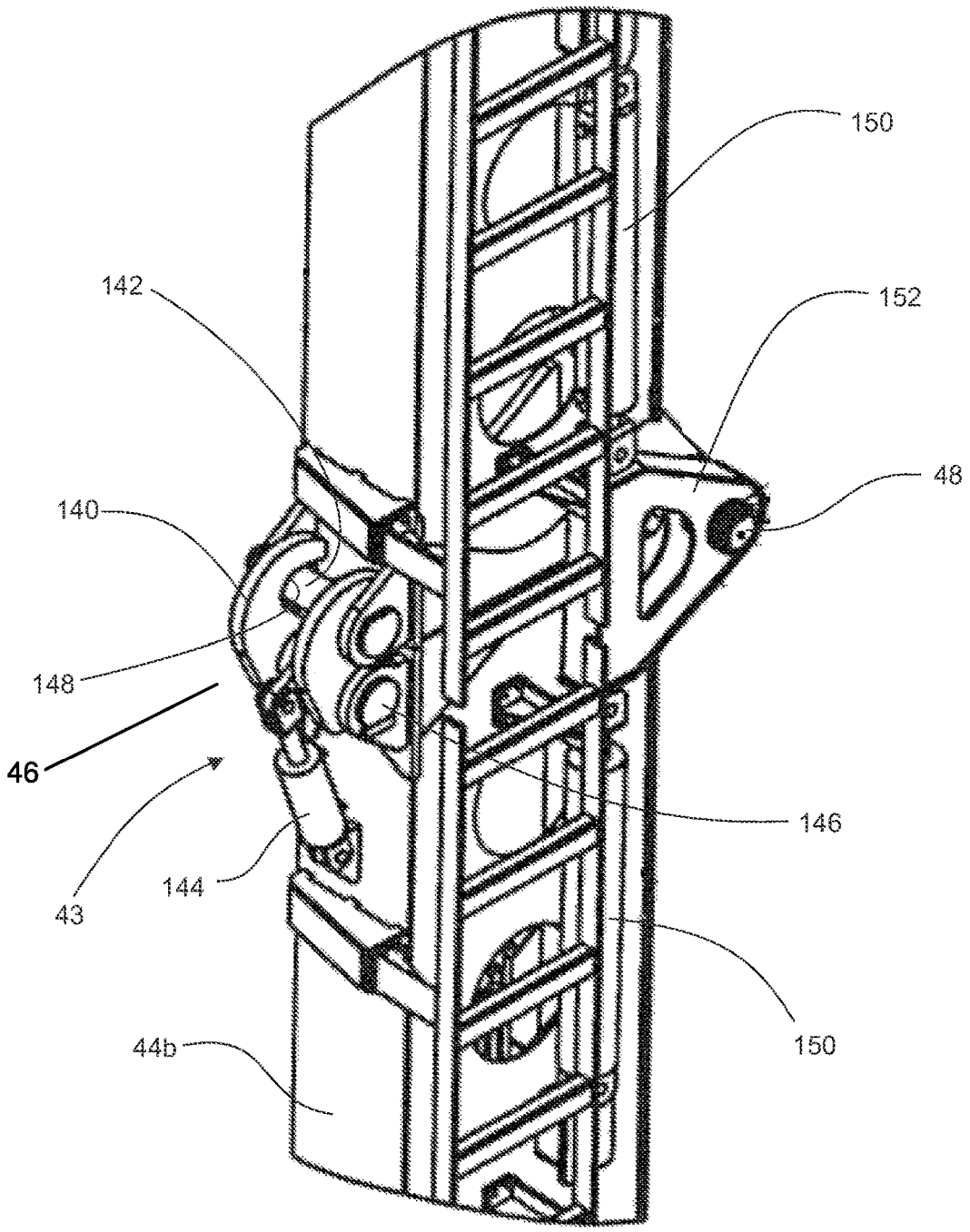
FIG. 2C is a partial perspective view of the locking clamp for the mast extension.

As shown in more detail in FIG. 2C, and illustrated in the latched or locked position, the mast lock comprises a releasable clamp 43 used for securing the first and second mast sections 40,42 together to ensure the folding mast 16 sections become, and temporarily remain, unitary during operation. In one embodiment, each releasable clamp 43, opposing each extension pivot 48, comprises a fold lock claw 140, a latch pin 142, and a claw actuator 144. The latch pin 142 may be connected to either the first or second mast section 40,42, while the fold lock claw 140 is pivotally connected to either the opposing second or first mast section 42,40, opposite the pin 142. Each claw 140 is pivotally connected to its respective mast section 40,42 at a claw pivot 146 and actuator 144, such as a hydraulic ram, rotates the claw 140 about the claw pivot 146 between two positions, firstly to lock the mast extension, by engaging a claw hook 148 with the latch pin 142, and secondly to disengage the hook 148 from the latch pin 142 to permit folding of the mast 16.

A pair of hydraulic rams 50,50 act to raise the base or first mast section 40 into an erect, operating configuration. The extension or second mast section 42 typically remains folded onto the first section 40 in a non-operating position. Each mast post 44*a*,44*b* is fit with facing toothed racks 52*a*,52*b* for incorporating a rack and pinion injector positioning system for selectively elevating the injector 22 along the length of the mast 16. As discussed for the configuration of FIG. 1A, loading applied to the mast 16 by the drive end CT supply imparts an over-turning load on the mast 16. Tensile releasable struts 60,60 act to resist the over-turning load (one strut 60 per mast post 44*a*,44*b*). Mast over-turning loads are transferred through the struts 60,60 into the structure of the mobile injector unit 12.

Figure 3A:
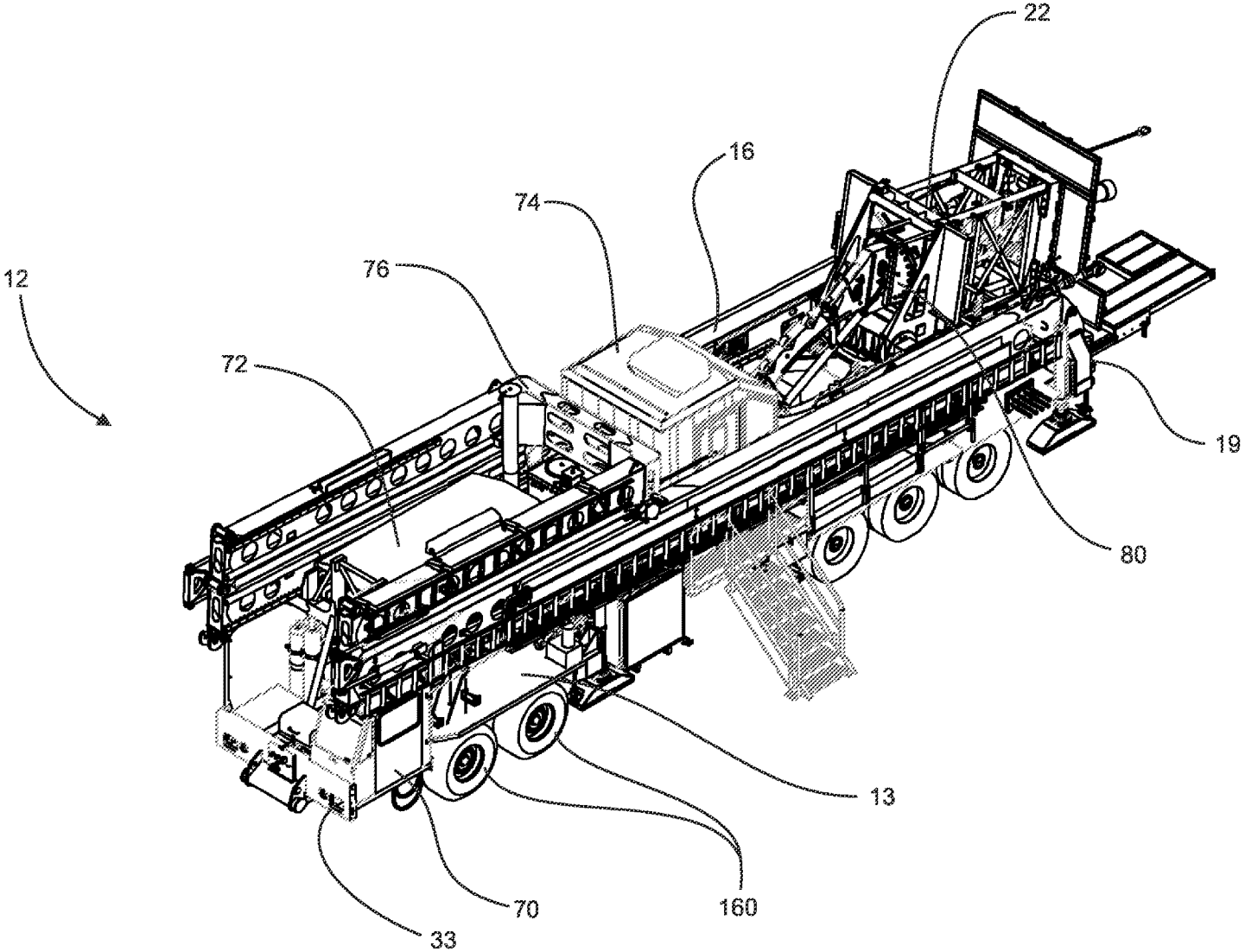
FIG. 3A is a perspective view of an embodiment of the coiled tubing injector unit while in a non operating configuration.

Having reference to FIG. 3A, the injector unit 12 is shown configured in a non-operating configuration, with the mast 16 in a stowed position, the posts 44*a*,44*b* substantially parallel to a mobile frame 13 of the injector unit 12 for transport. The gooseneck 26 and injector 22 are moved low in the mast 16 for transport.

Figure 3B:
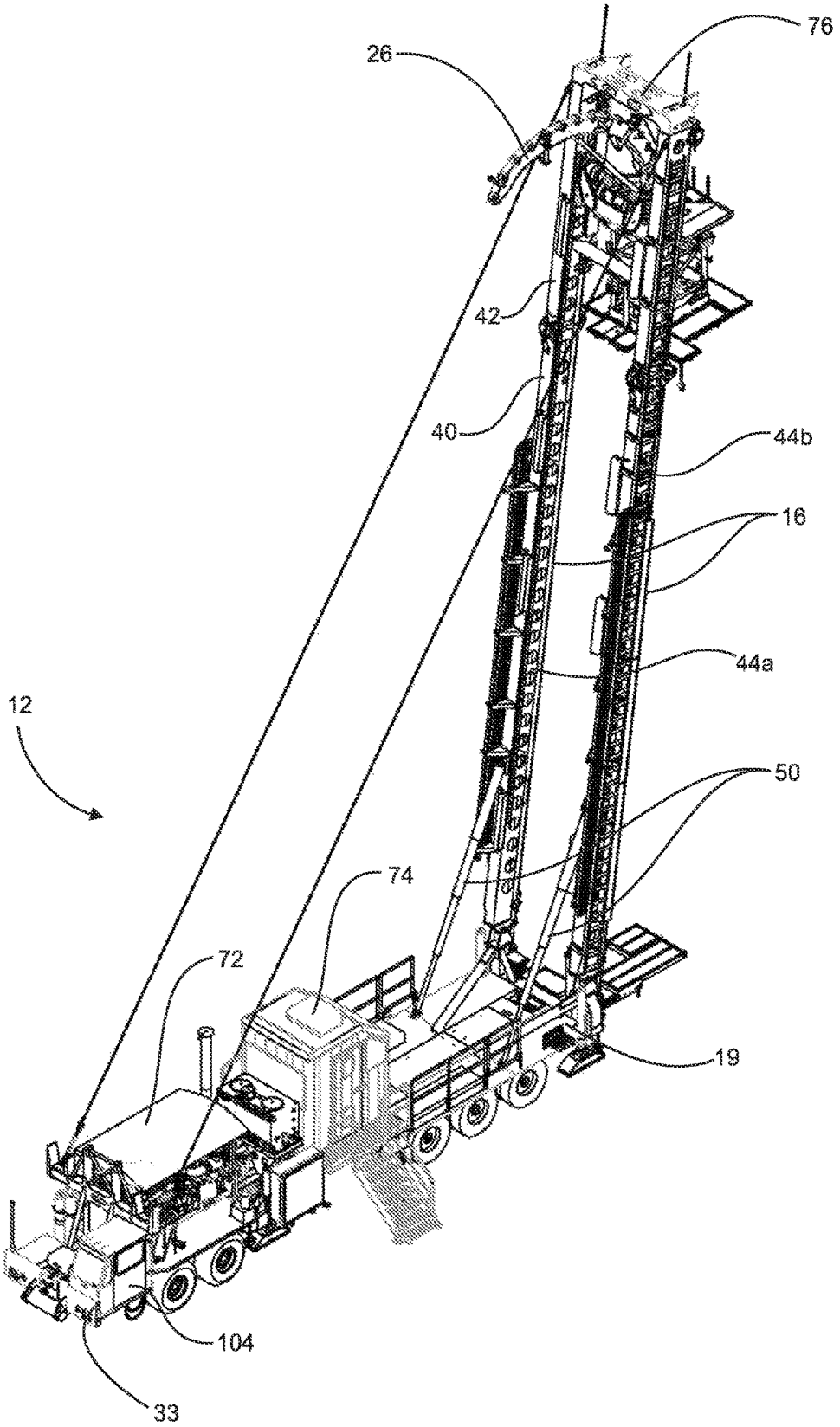
FIG. 3B is a perspective view of an embodiment of the coiled tubing injector unit while the mast is erected in an operating configuration.

In FIG. 3B, the injector unit 12 is shown configured in an operating configuration, with the mast 16 raised into a substantially vertical or erect position for injecting CT 2 into and out of a wellbore.

Having reference to both FIGS. 3A and 3B, the injector 22 is supported on the wellbore side of the mast 16. The gooseneck 26, provided for guiding the CT 2 to and from the CTRU 10, is rotatably connected atop the injector 22 for reorienting between a drive end configuration, for accepting supplied CT 2 from the CTRU 10, or the back end configuration, for accepting supplied CT from the wellhead side. A driver's cab 70 and power plant 72 can be fit at the drive end 33. The frame has a longitudinal axis between the front and back ends 33,19. The power plant 72 powers at least the self-propelled mobile frame. The driver's cab 70 and power plant 72 are lodged to advantage between the parallel mast posts 44*a*,44*b* when the mast 16 is stowed for transport. Further, a control cab 74 is located intermediate the injector unit 12, or mid-unit, and is spaced from the power plant 72 to as to accommodate the crown 76 of the folded mast 16. During transport, the control cab 74 is straddled by the pair of spaced longitudinally extending parallel mast posts 44*a*, 44*b*. Accordingly, the control cab 74 is located intermediate the crown 76 and the back end 19 when the mast 16 is in the folded, transport position.

Figure 4:
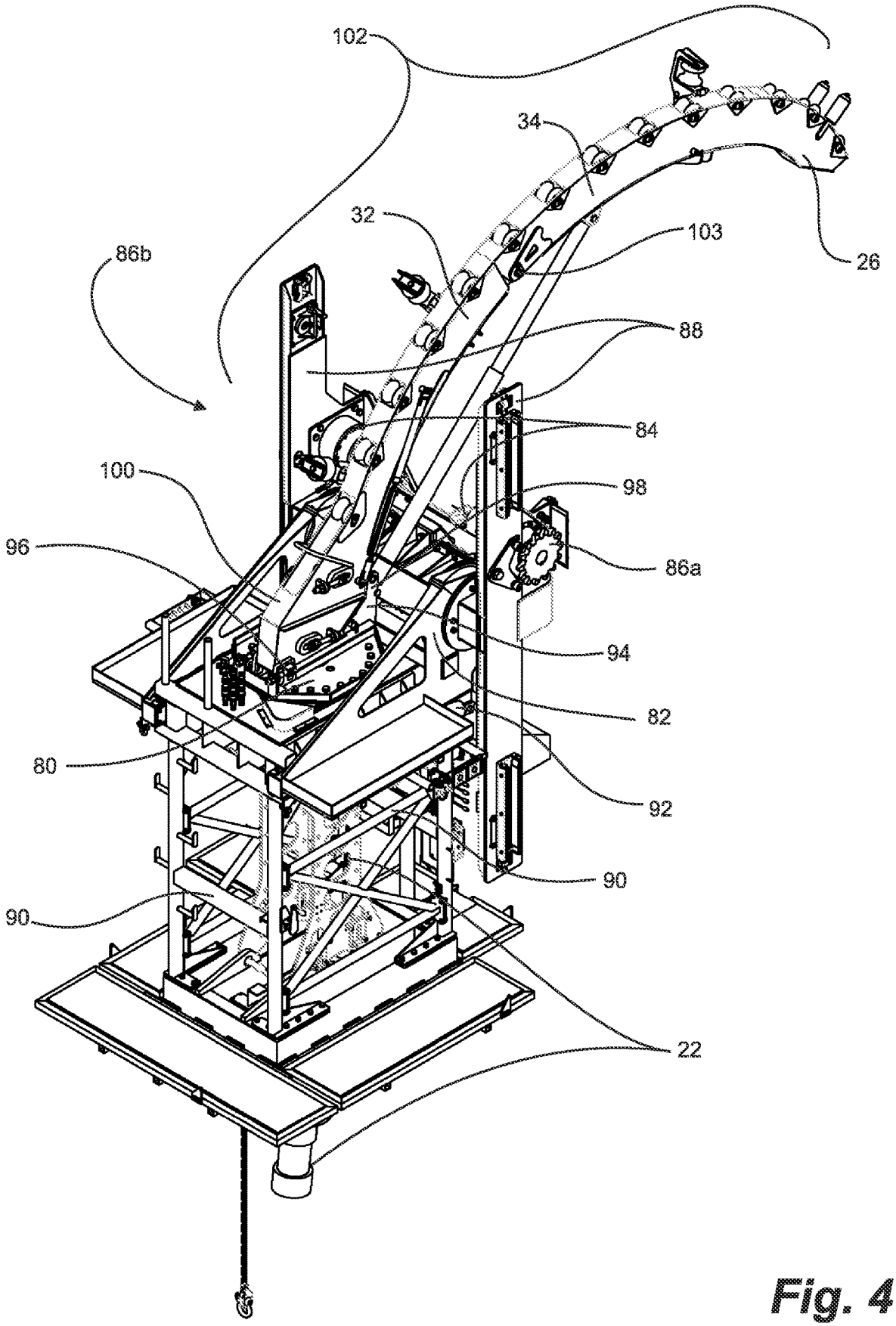
FIG. 4 is a perspective view of an embodiment of an injector, injector carriage and pinion drive, and a gooseneck having the arcuate CT guide section in an extended position.
Figure 8:
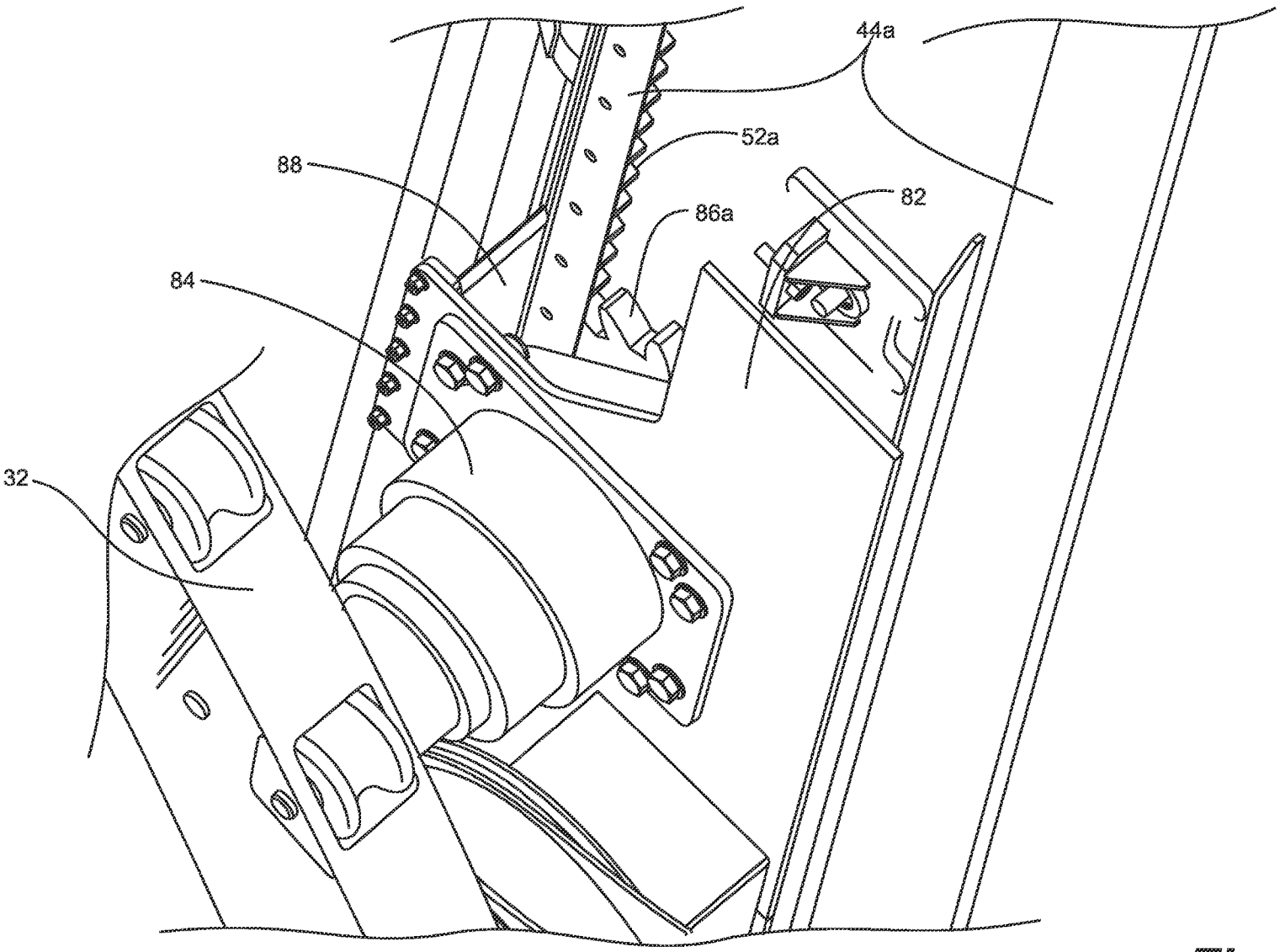
FIG. 8 is a perspective view of the rack and pinion system connecting the injector frame to the folding mast.

With reference to FIGS. 4 and 8 the injector 22 is mounted to a carriage 82 that is raised and lowered in the mast 16. The gooseneck 26 is rotatably connected to the injector 22 at a rotating support 80, such as a conventional plate, pin and pivot structure, not detailed herein. The rotational support 80 enables re-orienting of the gooseneck 26 so as to receive CT 2 from different directions. The gooseneck 26 has an effective turning radius which is quite large and would typically result in interference with the mast 16. The effective turning radius is manipulated by a combination of at least a folding of the gooseneck 26, translation of the gooseneck 26 away from the injector 22 and angular manipulation of the gooseneck 26 from the injector 22.

The carriage 82 supports the injector 22 and one or more drives 84 for opposing pinions 86*a*,86*b*. The pinions 86*a*, 86*b* engage their respective racks 52*a*,52*b* along the mast posts 44*a*,44*b* for driving the carriage 82 up and down the mast 16. The carriage 82 further comprises slides 88 which cooperate with the mast posts 44*a*,44*b* for stabilizing the carriage 82 relative to the mast 16 and aiding movement therealong.

The carriage 82 further incorporates an injector frame 90, positioned between the carriage 82 and the injector 22, and movable away from and towards the mast 16. The injector frame 90 thus enables translation of the injector 22. The injector frame 90 is actuated using a lateral actuator 92, such as a hydraulic cylinder. The injector frame 90, when moved away from the mast 16, aids in shifting the effective turning radius of the folded gooseneck 26 so as to be clear of the mast posts 44*a*,44*b*.

The rotating support 80 further comprises a guide socket structure 94 supported thereon having a gooseneck pivot 96, such as a pivot pin, pivotally coupling a proximal segment 32 of the gooseneck 26 to the rotating support 80. The guide socket structure 94 further comprises a guide lock 98, such as a locking pin, spaced from the gooseneck pivot 96 for securing the proximal segment 32 to the support 80 when it is desired to fix the gooseneck 26 to the injector 22, and removeable when the gooseneck 26 is to be pivoted about pivot 96. When locked, the guide lock 98 extends through both the guide socket structure 94 and the proximal segment 32, preventing tilting of the proximal segment 32. When the guide lock 98 is released, the proximal segment 32 is rotatable about guide pivot 96 to tilt the gooseneck 26. The gooseneck pivot 96 aids in moving, adjusting or shifting the effective turning radius of the folded gooseneck clear of the mast posts 44*a*,44*b*.

Figure 5A:
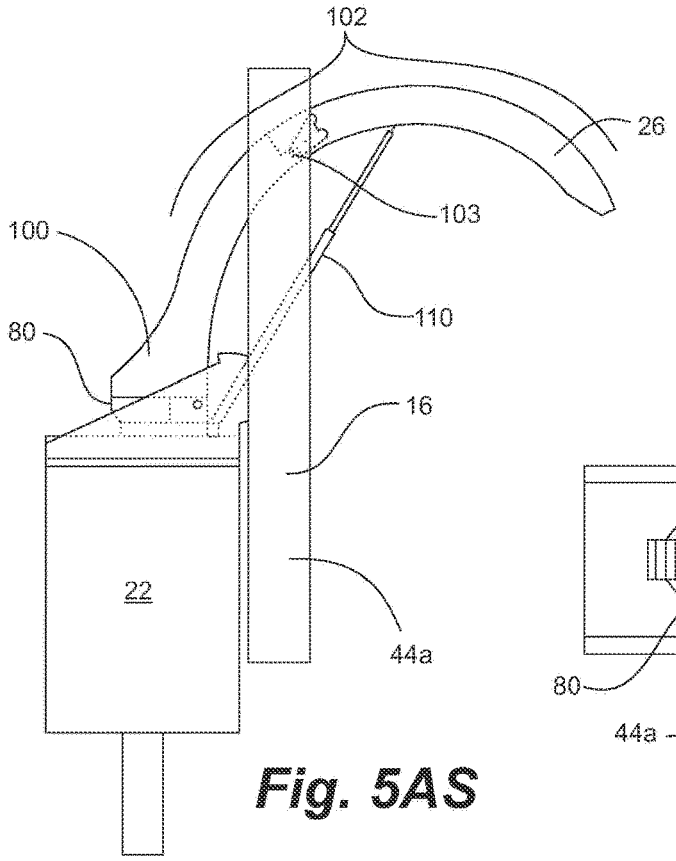
FIGS. 5AS through 5HT are pairs of simplified side (S) and top (T) views of a gooseneck and CT injector in a mast, the views illustrating in sequence how the gooseneck is reoriented from a drive side to a back end orientation, more particularly.
Figure 5A:
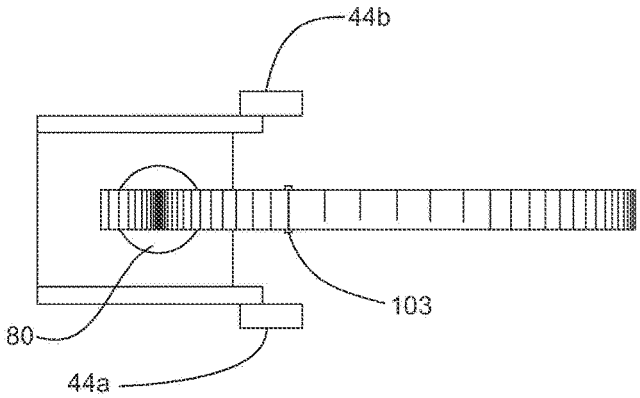

With reference to FIGS. 5AS through 5HT the gooseneck 26 can be reoriented from the drive end orientation to the back end orientation. The gooseneck 26 is mounted at the rotating support 80 to the CT injector 22. The gooseneck 26 normally extends between the pair of spaced and parallel mast posts 44*a*,44*b*. Therefore, without some accommodation, the gooseneck 26 would not readily rotate freely without risk of interference with the one or the other of the mast posts 44*a*,44*b*.

Accommodation is provided by a combination of at least a folding of the gooseneck 26 and rotation of the gooseneck 26 about the CT injector 22. Accommodation can be further aided by a tilting of the gooseneck 26 and a translation of the gooseneck 26 away from the mast 16.

Accordingly, for configuring the system between the drive end and a back end configuration, the gooseneck 26 can be manipulated for re-orienting above the CT injector 22. Having reference again to FIG. 4, the gooseneck 26 comprises a base 100, and an arcuate guide 102 comprising the proximal segment 32 adjacent the base 100 and a distal segment 34 extending away from the base 100 towards the CT reel 4. The distal segment 34 is pivotally connected to the proximal segment 32 at an intermediate guide pivot 103 for folding the arcuate guide 102 upon itself.

The gooseneck base 100 is connected to a top of the CT injector 22 at the rotating support 80. The distal and proximal segments 32,34 of the arcuate guide 102 fold to minimize their storage volume for transport but also to minimize the effective turning diameter or turning radius when rotated.

The proximal segment 32 is pivotally attached at the guide socket structure 94 which is integrated into the base 100 for tilting of the gooseneck 26. When secured, such as in use for injecting CT, the proximal segment 32 is bedded into the guide socket structure 94 and the guide lock, such as a locking pin 98, secures the proximal segment 32 to the base 100 to prevent rotation.

In this embodiment, the locking pin 98 extends through both the socket structure 94 and the base 100 of proximal segment 32, preventing tilting. When the guide locking pin 98 is released, the proximal segment 32 is rotatable about gooseneck pivot 96. Accordingly, when folded, the arcuate guide 102 can be tilted with respect to the injector 22 to manipulate the proximal or distal segments 32,34 relative to the mast posts 44*a*,44*b*. When the effective turning radius of the folded arcuate guide 102 is not compact enough to clear the mast 16, the gooseneck 26 can be tilted at the appropriate point of rotation.

As stated, the gooseneck 26 is re-positionable, by rotation, between the drive end and the back end configuration. The injector unit 12 and mast 16 are best able to resist CT loading substantially in line with the longitudinal axis of the injector unit 12, either towards, or away from, the injector unit, as described below. One can determine a safe angular tolerance either side of the longitudinal axis.

Accordingly, herein, rotation of the gooseneck 26 is described in the context of rotation from the drive end orientation, in line with the injector unit 12, to the back end orientation, in line with the injector unit 12.

Having reference to FIGS. 5AS and 5AT, the gooseneck 26 is shown initially oriented in line with the injector unit 12, mounted above the injector 22. The gooseneck 26 extends generally between the longitudinally extending parallel mast posts 44*a*, 44*b* and is oriented towards the injector unit 12. When CT operations are to be conducted from the back end 19 of the injector unit 12, the gooseneck 26 is rotated. Without accommodation, the gooseneck 26 cannot rotate out of the mast 16. The mast 16 can be an encumbrance to manipulation of the ungainly gooseneck 26 and thus a system and method is provided for enabling conversion from drive end to back end operations. The proximal segment 32 is locked using locking pin 98 to prevent rotation about support 80.

Figure 5B:
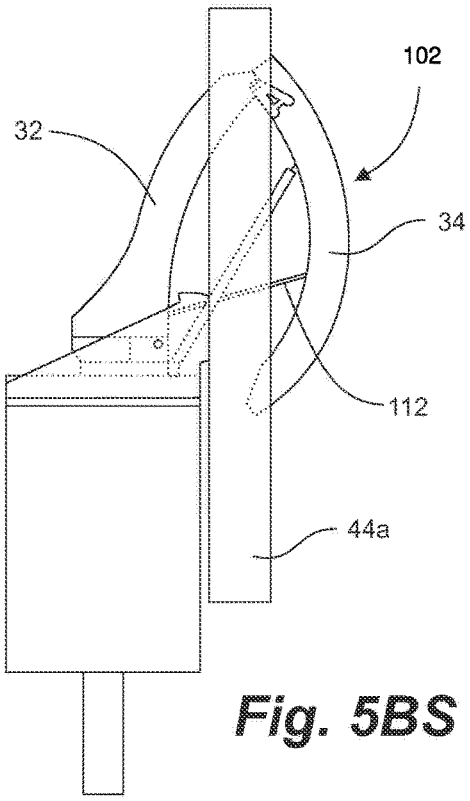
FIGS. 5BS and 5BT illustrate the gooseneck in a folded position in preparation for reorienting from the drive end towards the back end orientation.
Figure 5B:
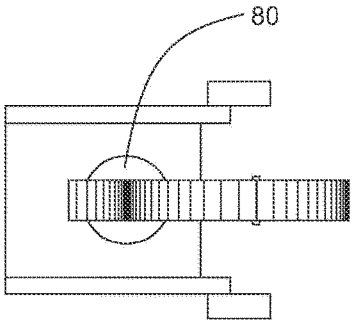

Having reference to FIGS. 5BS and 5BT, the gooseneck 26 is folded at the guide pivot 103 between proximal segment 32 and a distal segment 34, reducing the gooseneck's effective turning radius. A gooseneck actuator 110, such as a hydraulic ram, is provided for manipulating the distal segment 34 relative to the proximal segment 32. One end of the actuator 110 is pivotally mounted to the rotating support 80 and extends along a chord for pivotal connection to the distal segment 34. To fold the arcuate guide 102, the actuator 110 is retracted, pivoting the distal segment 34 relative to the proximal segment 32 about the guide pivot 103. When folded, a strut, shipping linkage or fold lock 112 is installed between the proximal segment 32 and the distal segment 34 of the gooseneck 26, to retain the gooseneck 26 in the folded position during shipping and during further orientation maneuvers.

Figure 5C:
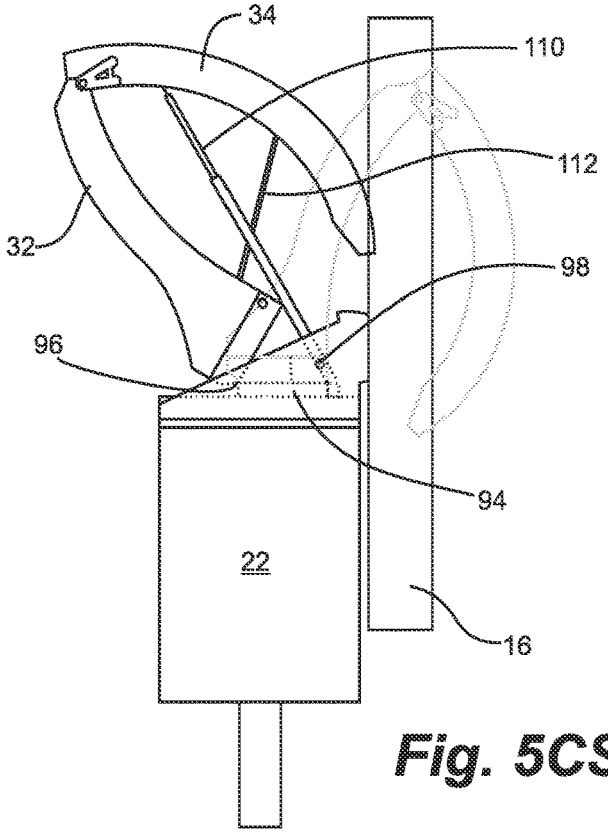
FIGS. 5CS and 5CT illustrate the gooseneck tilted approximately 60 degrees to the drive side from the injector.
Figure 5C:
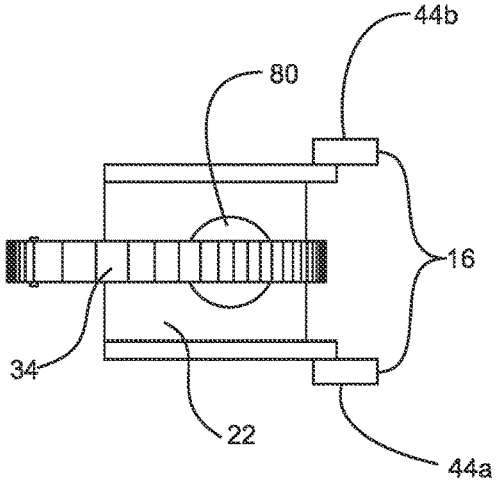

Turning to FIGS. 5CS and 5CT, when the effective turning radius of the folded gooseneck 26 is greater than the inside, side-to-side clearance between the sides of the parallel mast posts 44*a*, 44*b*, the gooseneck 26 is tilted at the gooseneck pivot 96 at the rotating support 80. To minimize a rotating radial sweep area or effective turning radius of the folded gooseneck 26, the locking pin 98 is temporarily retracted or removed to permit the gooseneck 26 to be tilted partially out from between the sides of the mast 16. The actuator 110 is used again, extending to rotate the folded gooseneck 26 about the gooseneck pivot 96. The fold lock 112 maintains the gooseneck's folded position and thus, when the actuator 110 is extended, the folded gooseneck 26 is caused to tilt.

Thus, the actuator 110, in conjunction with the gooseneck pivot 96 and locking pin 98, first enables positioning of the gooseneck 26 between the extended position (FIG. 5AS) and the folded position (FIG. 5BS). The extended position permits operations for guiding CT 2. The folded position is used for shipping, transport and rotating. Secondly, the actuator 110 tilts the folded gooseneck 26 about the gooseneck pivot 96 to provide additional clearance between the distal segment 34 of the gooseneck 26 and the mast posts 44*a*, 44*b* permitting rotation of the gooseneck 26.

Figure 5D:
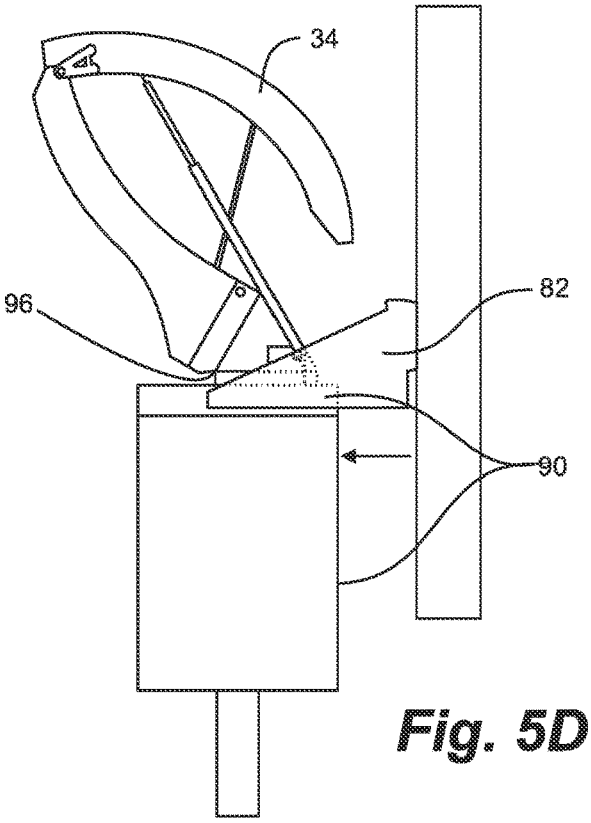
FIGS. 5DS and 5DT illustrate the injector and gooseneck translated away from the mast to at least partially clear the mast.
Figure 5D:
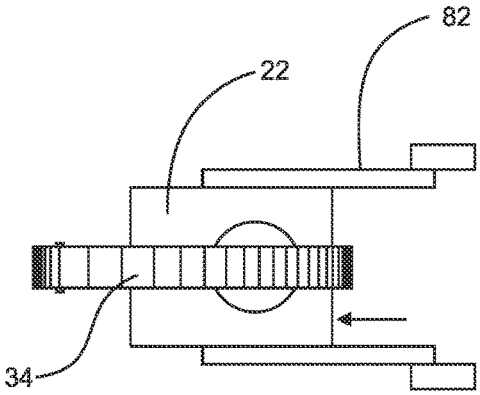

As shown in FIGS. 5DS and 5DT, for additional clearance, the injector 22 is then displaced laterally away from the parallel mast posts 44*a*,44*b*. The CT injector 22 is displaced or translated away from, and towards, the mast 16 by displacing the injector frame 90 using the lateral positioning member 92 such as a hydraulic cylinder. Thus, the distal segment 34 of the gooseneck 26 is displaced, as needed, from between the parallel mast posts 44*a*,44, and as a result, the distal segment 34 of the gooseneck 26 is free rotate without interference by the mast 16.

Figure 5E:
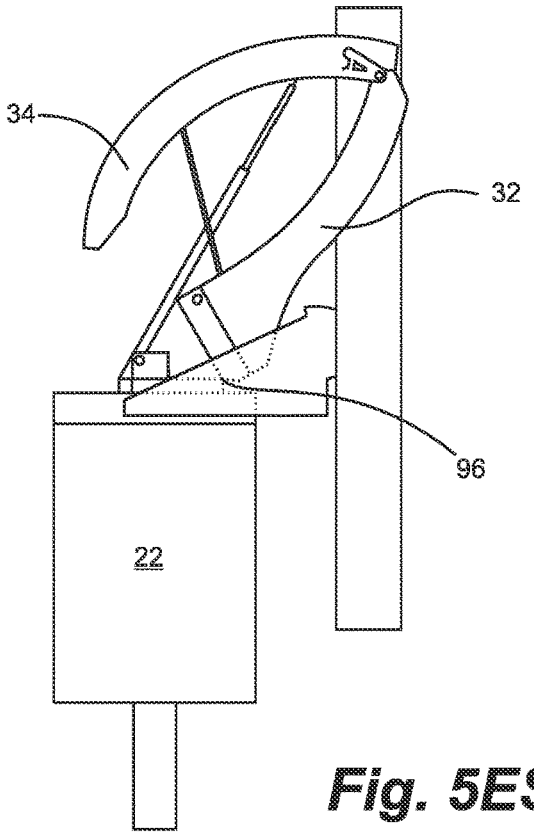
FIGS. 5ES and 5ET illustrate the gooseneck partially rotated until interference with the mast.
Figure 5E:
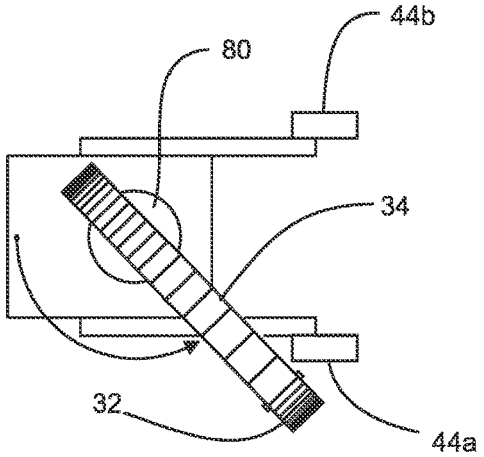

With reference to FIGS. 5ES and 5ET, the gooseneck 26 is rotated using the rotating support 80 to re-orient the arcuate guide 102 to the back end orientation. As shown, as tilted, the proximal segment 32 of the gooseneck 26 when titled can be rotated until it encounters interference by the mast 16, such as mast post 44*a*. As shown in FIG. 5ET, the gooseneck 26 is rotated about 90 to 120 degrees until the proximal segment 32 interferes with the mast post 44*a*.

During the rotation or when interference is detected, the actuator 110 is retracted to lessen the angle of tilt of the gooseneck 26 for spacing the proximal segment 32 further from the dual folding masts 44*a*, 44*b*, clearing the rotational path and enabling completion of rotation thereof.

Figure 5F:
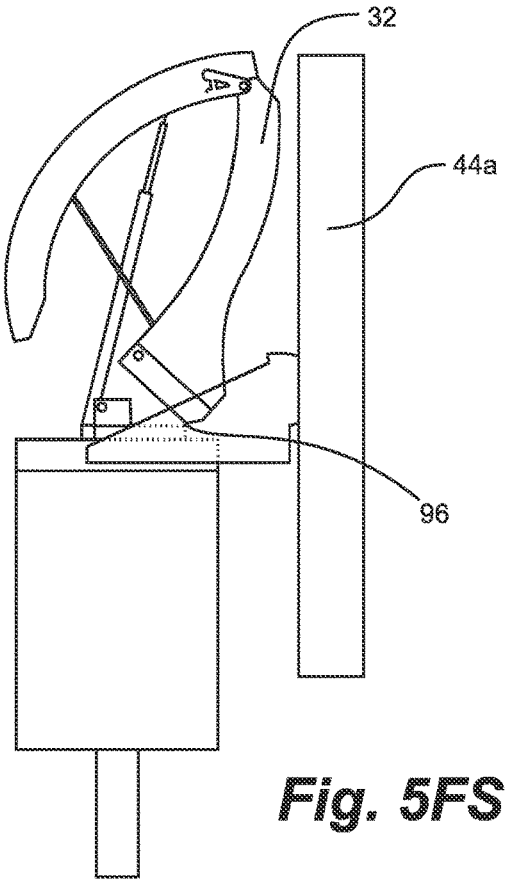
FIGS. 5FS and 5FT illustrate the gooseneck tilted back towards the injector to clear the mast and complete the rotation to the back end.
Figure 5F:
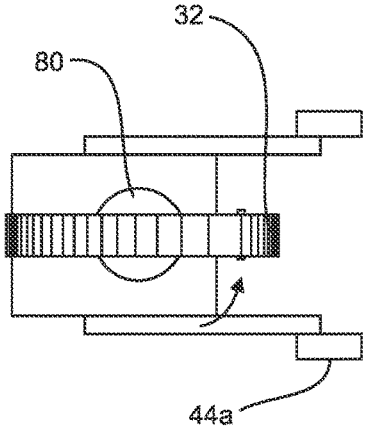

As shown in FIGS. 5FS and 5FT, the gooseneck 26 is then rotated the balance of the rotation from the drive end orientation to the back end orientation, about 180 degrees in total. The locking pin 98 can be inserted before or after rotation.

Figure 5G:
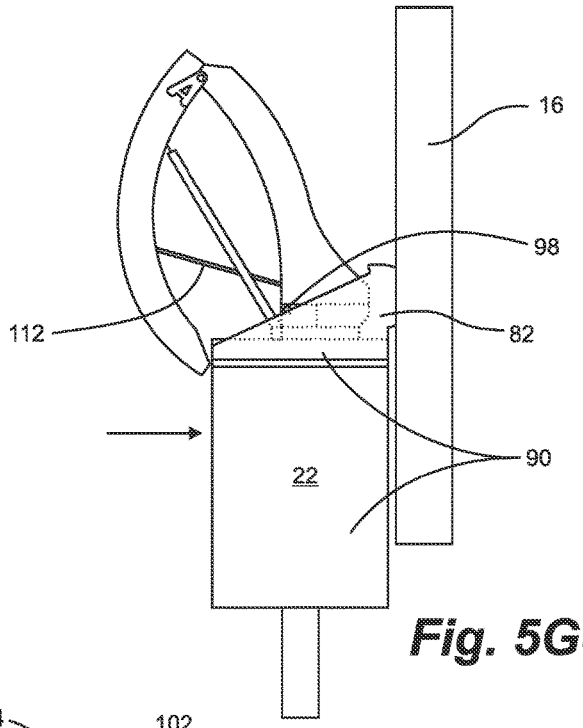
FIGS. 5GS and 5GT illustrate the gooseneck tilted for securing to the injector and the injector translated back towards the mast.
Figure 5G:
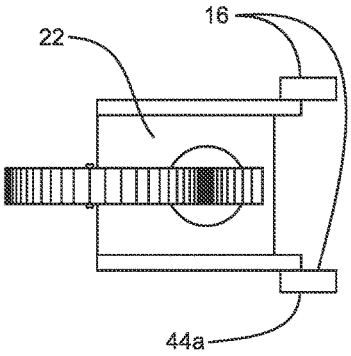

At FIGS. 5GS and 5GT, the injector 22 is then laterally repositioned towards the mast 16.

Figure 5H:
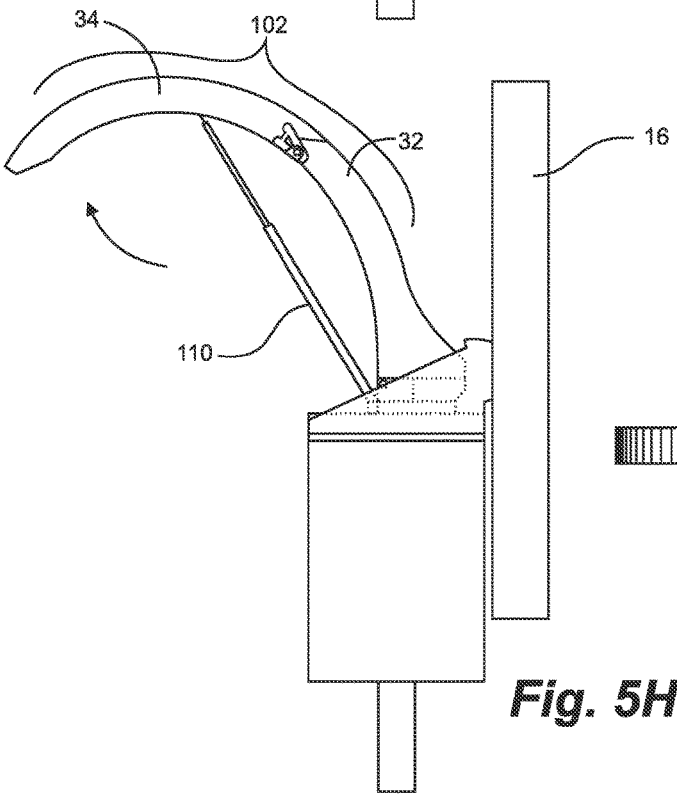
FIGS. 5HS and 5HT illustrate the gooseneck arcuate guide section extended to the back end for operations.
Figure 5H:
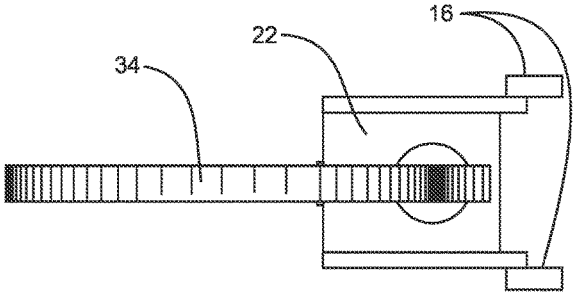
Figure 6:
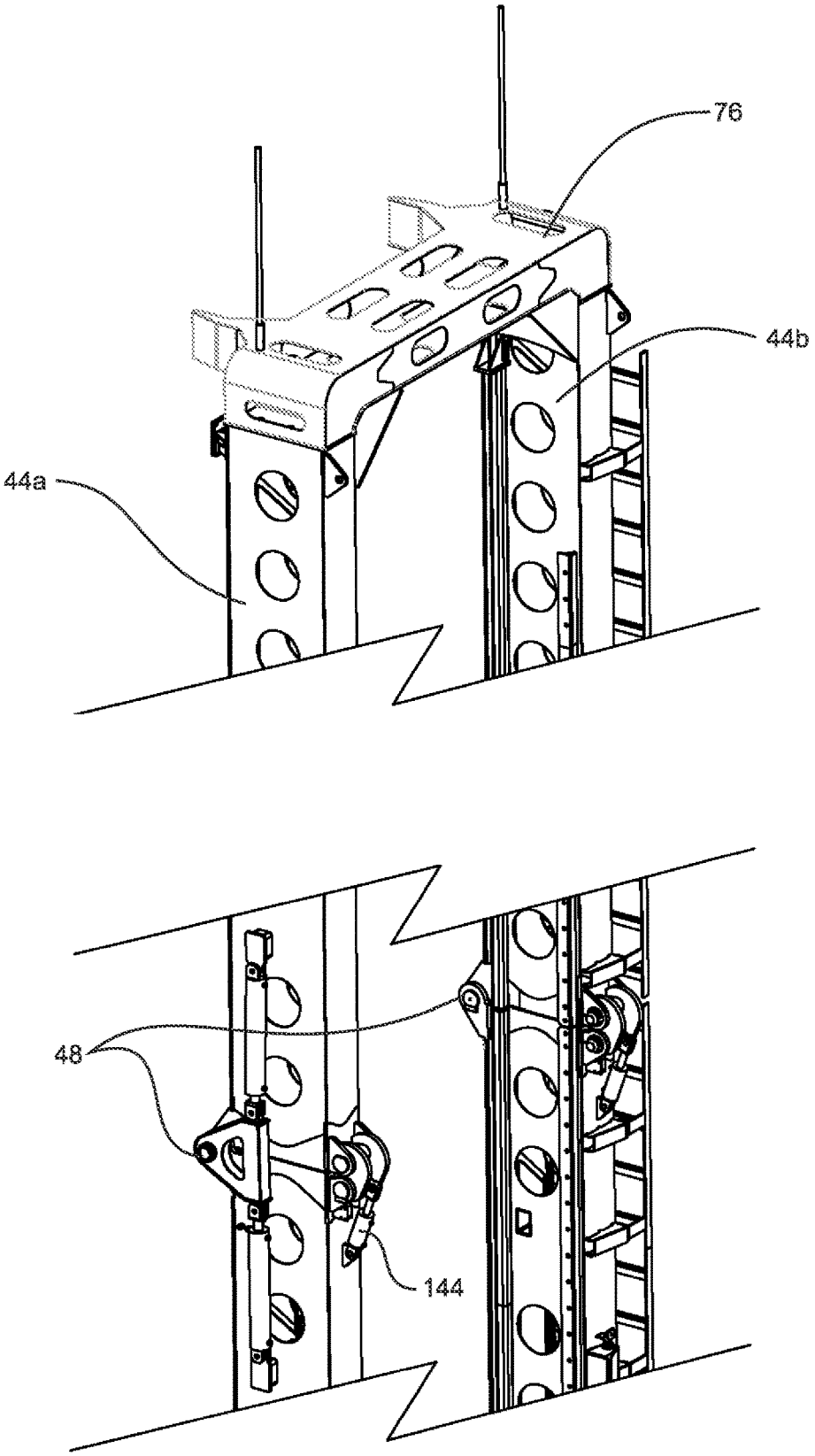
FIG. 6 is a partial and perspective view of an embodiment of the parallel mast posts having the pivot, folding and a form of claw latch locking mechanisms of a folding mast according to one embodiment.
Figure 7A:
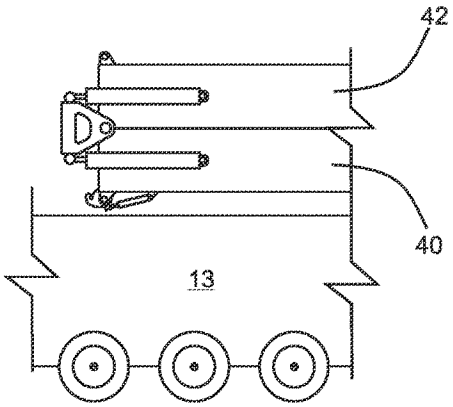
FIGS. 7A through 7G are a series of partial side views illustrating the pivot or hinged portion of the folding mast according to FIG. 6, the base and extension portions of the mast shown in a sequence from transport to an erected position, more particularly.
Figure 7B:
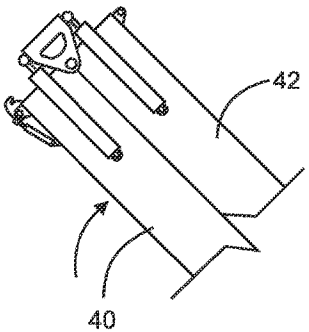
Figure 7C:
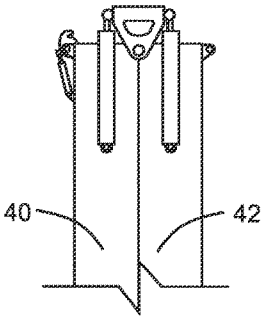
Figure 7D:
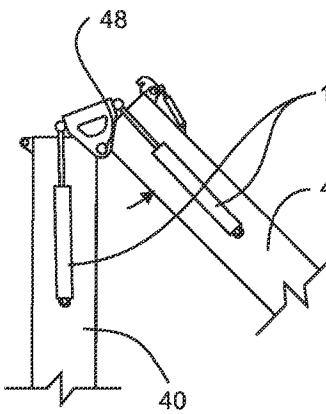
Figure 7E:
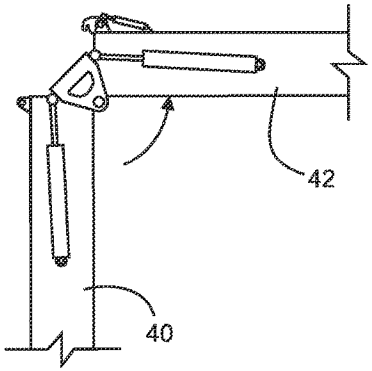
Figure 7F:
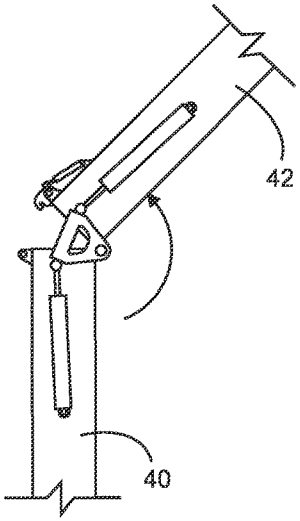
Figure 7G:
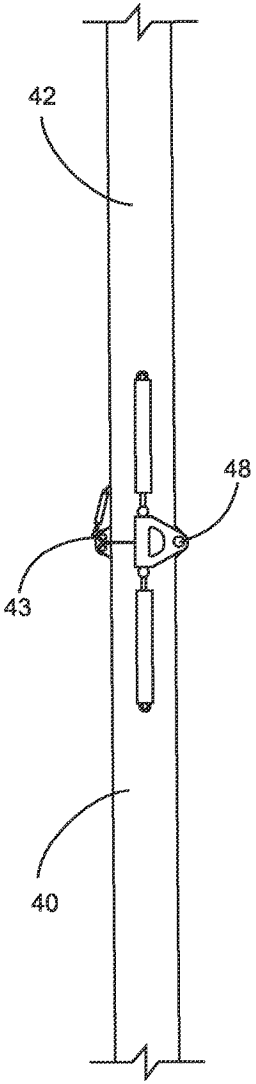

Having reference to FIGS. 5HS and 5HT, once the injector 22 is retracted into the carriage 82 and oriented in the back end orientation for CT operations, the fold lock 112 is removed. The actuator 110 is used to extend the distal segment 34, to unfold and form the arcuate guide 102. The arcuate guide is then locked in the unfolded position for operations in the back end orientation.

In greater detail, and returning to FIGS. 2A, 2B, 3B, the folding mast 16 has an extension pivot point 48 intermediate its extended or erect length. The entirety of the mast, having significant height, fits on a single roadable, mobile platform or frame 13. The folding mast 16 is hydraulically lifted and support structure is provided to resist supplied CT loading without need for or overloading the hydraulic lifting mechanism. The mast 16 is folded and unfolded in two stages. Once fully unfolded to the extended position, the locking clamp 43 is engaged to ensure the folding mast becomes structurally unitary. As a result, the folding mast 16 has a useful injector-to-ground height in the order of about 50 feet, yet remains foldable for transport to less than about 40 feet in length.

The control cab 74 is positioned about mid-carrier, straddled by the mast 16 during transport.

The entirety of the mast 16 can be lifted from the non-operating configuration of FIG. 3A to the operating configuration of FIG. 3B using the pair of hydraulic rams 50,50 connected between the first mobile frame 13 and the first mast section 40. In the operating configuration of FIG. 3B the first and second mast sections 40,42 longitudinally align in a substantially vertical orientation, such as a slightly inclined position to align the injector 22 over a wellhead. In the non-operating configuration FIG. 3A the second mast section 52 folds onto first mast section 50, resting on and adjacent to the mobile frame 13 of the injector unit 12.

With reference to FIG. 2C, 6, and FIGS. 7A through 7G, each extension pivot 48 comprises a pair of opposing, two-stage, first and second actuators 150,150, such as hydraulic rams. The pivot 48 further comprises a generally triangular fulcrum 152, having three apexes, a first apex pivotally attached co-axially to the extension pivot 48 and the actuators 150,150 at the other two opposing apexes. The actuators 150,150 extend between the fulcrum 152 and their respective mast sections, each actuator 150 to the fulcrum 152 at second and third opposing apexes, each apex being spaced away from the extension pivot 48 so to provide the necessary actuation leverage. When the mast 16 is the folded position, the actuators 150,150 are extended. As the actuators 150,150 are actuated to retract, the second mast section 42 is pivoted about 180 degrees about mast pivot 48 until in line with the first mast section 40. In an alternative embodiment, there may be only one two stage folding pivot 48 on the parallel mast posts 44*a*,44*b*.

Once the mast 16 is completely unfolded to the operating configuration, the releasable clamp 43 secures the first and second mast sections 40,42 together to ensure the folding mast sections become, and temporarily remain, unitary during operation. As discussed above, in one embodiment, the releasable clamp comprises the fold lock claw 140 and the latch pin 142 are fit to either one of the first or second mast sections 40,42.

In operation, and having reference to FIG. 2A and FIGS. 7A-7C the coiled tubing injector unit 12 enters a well site with the mast 16 in the folded, non-operating position. The pair of actuators 50,50 (FIG. 2A) raise the first mast section 40 into an operating configuration while the second mast section 42 remains in a folded non-operating position.

With reference to FIGS. 7D through 7G, the pair of pivot actuators 150,150 are then actuated either sequentially (serial two-stage, actuator 150 then actuator 150) or in unison (parallel two-stage 150 and 150) for raising the second mast section 42 into an operating configuration. If actuated serially, the two-stage folding pivot 48 rotates the second mast section 42 approximately half way, being zero to 90 degrees, in the first stage, and the remainder of the way, being 90 to 180 degrees, in the second stage. The first and second mast sections 40,42 are longitudinally aligned in a substantially vertical position once in the operating configuration. The fold lock claw 140 is then engaged using the actuator 144 for engaging the latch pin 142, locking together the first and second mast sections 40,42. Prior to folding the mast 16 to the non-operating configuration, the claw 140 is actuated to disengage from the pin 142, and the second mast section 42 is able to pivot into a folded position.

In an alternative embodiment, the second mast section 42 may be raised to the operating position prior to the first mast section 40 being raised so that the mast 16 is fully extended yet lying substantially horizontal and parallel to the movable mobile frame 13 of the injector unit 12 before lifting. The first and second mast sections 40,42 may then be positioned while extended into a substantially vertical position using the hydraulic rams 50,50.

Therefore the mast 16 having first and second foldable mast sections 40,42 is provided having a useful injector-to-ground height of approximately 50 feet, yet foldable for transport to less than 40 feet.

The control cab 77 is positioned mid-carrier, and straddled by the mast 16 during transport.

Having reference to FIGS. 2A, 2B and 8, prior art drawworks cabling for injector manipulation is eliminated through introduction of a rack and pinion, CT injector positioning system for selectively moving the injector 22 up and down, and along, the length of the mast 16. Herein, the cable-less rack and pinion positioning system works particularly well with the folding mast 16, substantially seamlessly bridging the folding mast's 16 intermediate mast pivot 48. Applicant's experience is that the prior art rack and pinion drives, used for conventional drilling rigs handling full string weights, were an uncomfortable compromise between low gearing to manage full string loads and higher gearing for faster tripping operations. For CT operations, using embodiments described herein, rack and pinion drive ratios can be optimized for positioning of the injector 22 and managing the dead loads of the injector 22 and surface coil weights. Running loads are supported by the injector 22, to the lubricator, to the wellhead.

In one embodiment, the pair of toothed racks 52*a*,52*b* are mounted to extend along the parallel facing mast posts 44*a*,44*b* for each of the first and second mast sections 40,42. Each of the racks 52*a*,52*b* are provided in two sections, corresponding to the respective first and second mast sections 40,42. When the mast 16 is in the non-operating configuration the two sections of each of the racks 52*a*,52*b* are separated and discontinuous along the mast 16. In an operating configuration, ends of the two sections of each of the racks abut to form a substantially continuous toothed rack 52*a* and 52*b*, bridging their respective mast pivots 48.

A pair of drives 84,84 one per rack 52*a*,52*b*, are mounted to the injector carriage 82 for selectively moving the CT injector 22 along the mast 16. The pair of pinions or pinion gears 86*a*,86*b* on the carriage 82 are craven by the pair of drives 84 for engaging the toothed racks 52*a*,52*b*.

Having reference to FIGS. 1A, 2A and 2B, for CT operations from the drive end orientation, a first tensile member, such as a releasable strut 60 for each mast post 44*a*,44*b*, is provided for transferring loads into the mobile frame 13 of the injector unit 12. The mast 16 pivots at its base at the mast pivot 18 at the back end 19 of the injector unit 12. CT operations from the drive end of the injector unit 12 impart lateral pulling loads on the mast 16 at about the gooseneck 26, and directed towards the drive end of the injector unit 12. This loading can be partially offset by the dead load of the injector 22 on the opposing, wellhead side of the mast 16. The mast-lifting actuators 50 can be used to impart a resisting force on the first mast segment 40, resulting in a large bending moment in the mast 16, at an intermediate lifting point 152. Thus, for operations, the tensile releasable strut 60 is positioned between the back of the erect mast 16, being the tensile surface of the mast 16 as a beam in bending, to the back end 19 of the mobile frame 13 of the injector unit 12.

Having reference to FIG. 1B, when the gooseneck 26 is re-oriented for back end orientation, the aforementioned loading scenario is reversed, the tensile releasable struts 60,60 no longer being effective in compression. Hence, the mast 16 is further supported using second tensile members such as guy wires 31 extending from the mast 16 to a point intermediate towards the front 33 of the mobile injector unit 12. In one embodiment, the guy wires 110 extend from a point adjacent the crown 76 of the mast 16 to a point adjacent the drive end 33 of the injector unit 12 for resisting CT forces and injector dead load transferred to the mast 16.

In an alternative embodiment, the guy wires 31 can also extend from alternate positions along the length of the mast 16 such as from a position adjacent the injector 22.

Referring again to FIG. 3A, and in one embodiment, the CT injector unit 12 may be self-propelled and remains within road weight and height allowances. The power plant or engine 72 provides at least power to wheels 160 for propelling or driving the unit 12 from well site to well site. The driving cab 70 is provided at the drive end 33. The engine 72 can be located between the driving cab 74 and the control cab 74. The control cab 74 is located about the middle of the injector unit 12. The mast 16, when positioned in the non-operating transport configuration, straddles the control cab 74. The stowed mast 16 sits sufficiently low on the mobile injector unit 12 to remain within the transport envelope including road height allowances.

Figure 9:
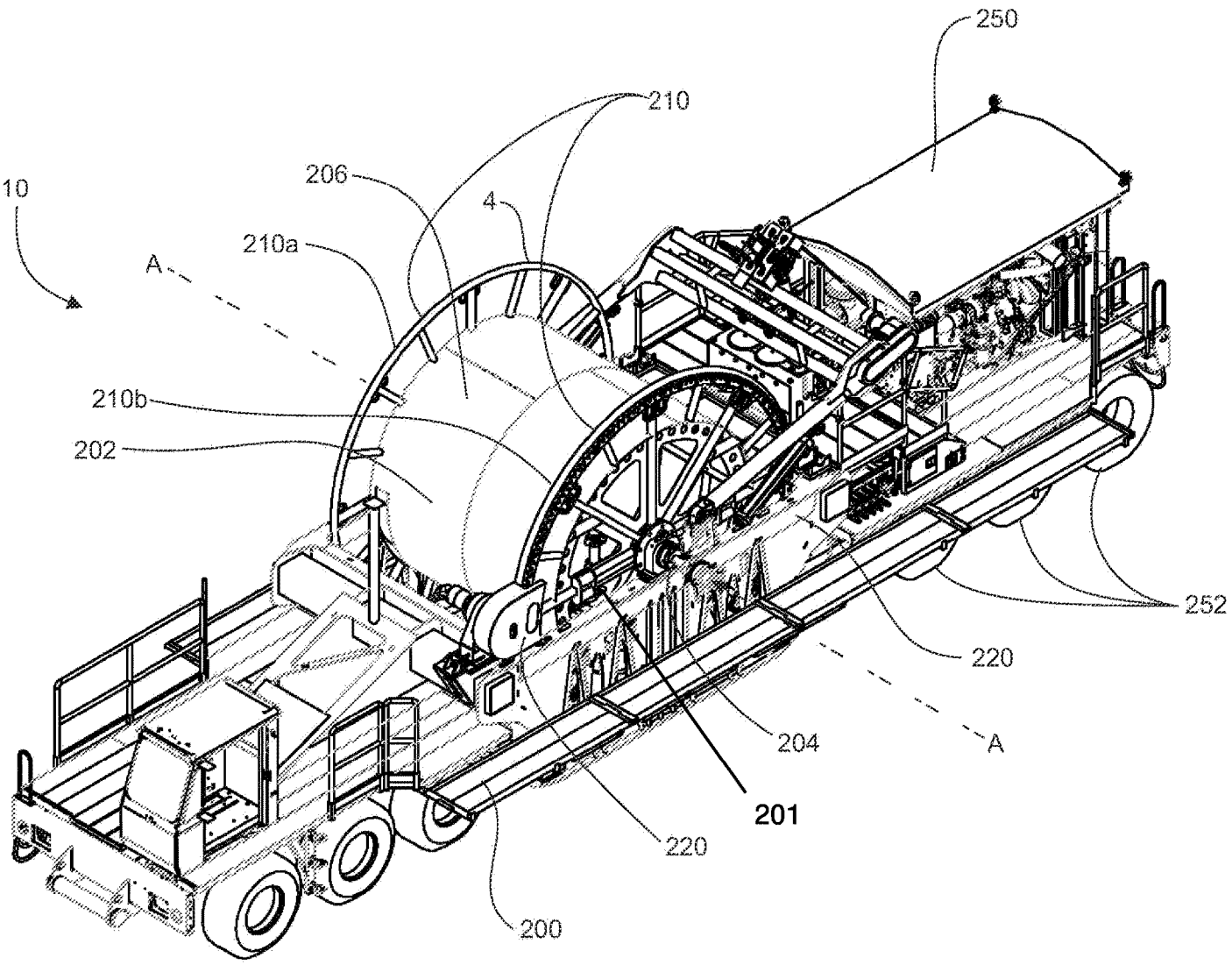
FIG. 9 is a perspective view of the mobile coiled tubing reel unit.

Having reference to FIG. 9, the separate CT reel unit 10 (CTRU) is provided comprising a mobile frame 200 for transporting and supporting the reel 4 of CT 2, the frame 200 also having a transport envelope, the height and width of which being substantially that of specified transport or road allowances. The reel 4 is located intermediate the frame 200 and has a maximized diametral extent that is accommodated in a support frame portion 201 in the frame 200 located between the front and rear wheels. The reel 4 can be removable and is rotatably connected through the support frame portion 201. The reel 4 extends substantially the width of the frame of the CTRU 10. The reel 4 is rotatable about an axle 204 having axis A, for spooling CT 2 onto and off of the reel 4. A drive system 202 rotates the reel 4 about the axis A. As the CTRU 10 has a separate mobile frame 200, site positioning of CTRU 10 remains flexible.

Coupled with the above injector 22 and a rotatable gooseneck 26, and with the gooseneck 26 positioned in the drive end orientation, the CTRU 10 is generally located at the drive end 33 of the injector unit 12 with the CT 2 extending over the injector unit 12 and into the arcuate guide 102 of gooseneck 26 (see FIG. 1A). This orientation requires an increased amount of real estate on one side of the wellhead than that typically required for coiled tubing operations in the prior art. The site lease may not permit end-to-end positioning of the injector unit 12 and CTRU 10 on one side of the wellhead. Accordingly, the CTRU 10 can be located on the opposite side of the wellhead, opposing the injector unit 12 (see FIG. 1B) and thus the gooseneck 26 would be repositioned to the back end orientation.

The CTRU 10, being separate from the injector unit 12, is optimized for maximizing CT length or weight. Prior art CT rigs are constrained as to the amount of CT they carry due to limitations on the size of the reel incorporated in a unitary platform which must also include a mast and injector. The size of prior art reels, particularly their width, are also constrained by the available space between the parallel mast posts to enable the mast to lay down for transport.

In contradistinction, embodiments provided herein have a removable reel 4, or cartridge, carried by its own CTRU 10 and can now maximize the length of CT and maximize CT capacity, by utilizing virtually the entirely of the width of the CTRU 10. Further, maximum diameter can be achieved, being substantially that of the road height allowance. As described below, reel drive and mobile platform improvements enable such increase in capability.

In operation, prior art chain drives to the shaft of a reel have conventionally being placed laterally adjacent to the reel, axially spaced on one side thereof, limiting the width of the reel that can be fit to the frame. In an embodiment disclosed herein, known chain drives have been removed and replaced with a drive system for operating the increased capacity reel 4 from the periphery of the reel as opposed to the side thereof.

Having reference to FIGS. 9 to 13 the reel 4 is a spool having the axle 204 and a tubing drum 206 that is bounded by at least one bounding flange 210, typically a pair of bounding flanges 210*a* and 210*b*, between which the CT 2 is wound. The CT reel 4 fits intermediate the longitudinal extent of the frame between the front and rear wheels. The drive system 202 comprises a drive 220, such as a planetary drive, that drives the reel 4 about a periphery of at least one driven bounding flange 210. While a chain drive about the flange 210 would assist with maximizing reel width, further advantage is obtained by eliminating chains altogether.

Figure 10:
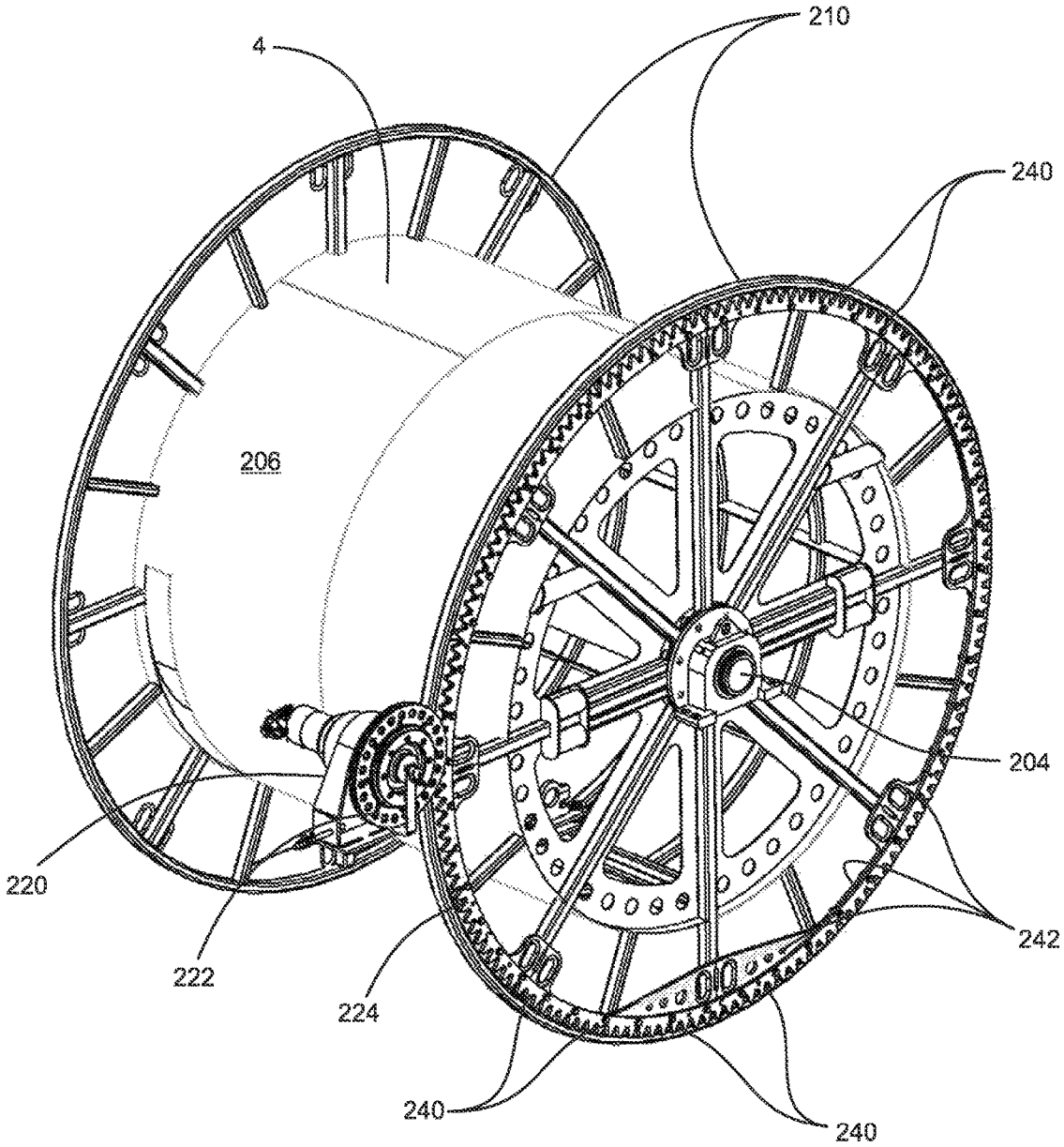
FIG. 10 is an isolated perspective view of an embodiment of the reel drive system, limited to the reel, bull gear and drive.

With reference to FIG. 10, the drive 220 is radially offset from the reel axis A. The drive gear 222 drives a sprocket or bull gear 224 fit about flange 210. The drive 220 is supported upon the mobile frame 200 for driveably engaging the drive gear 222 with the bull gear 224. Therefore, need for a conventional, axially spaced chain drive and impact on width is eliminated. As the drive gear 222 is parallel and radially offset from the reel 4, spaced longitudinally along the CTRU 10 as opposed to spaced axially along the reel axis, the reel 4 can extend substantially the width of the frame 200, maximizing the reel capacity. Further, use of a drive and bull gear 222,224, eliminates chain breakage and associated risk to operators.

The mobile frame 200, such as that of FIG. 9, has an inherent flexibility, albeit minimal in the context of serving as transport apparatus, but which introduces challenges to maintaining engagement of drive gear 222 and bull gear 224. Engagement issues can include manufacturing tolerances and alignment, alignment including angular variations in the parallel offset of the drive gear 222 and bull gear 224.

Figure 11A:
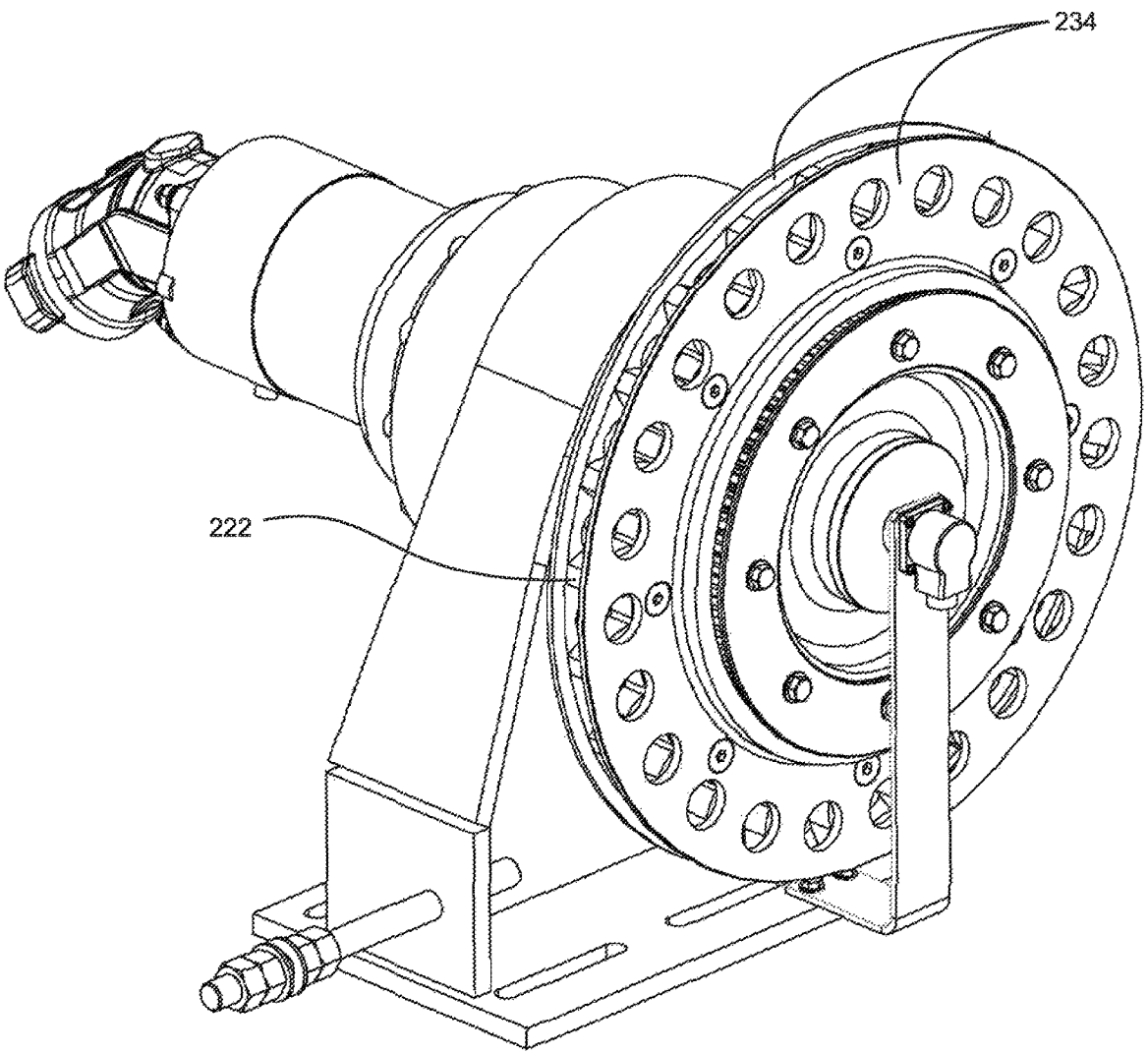
FIG. 11A is a perspective view of an embodiment of the drive and drive gear according to FIG. 10.
Figure 11B:
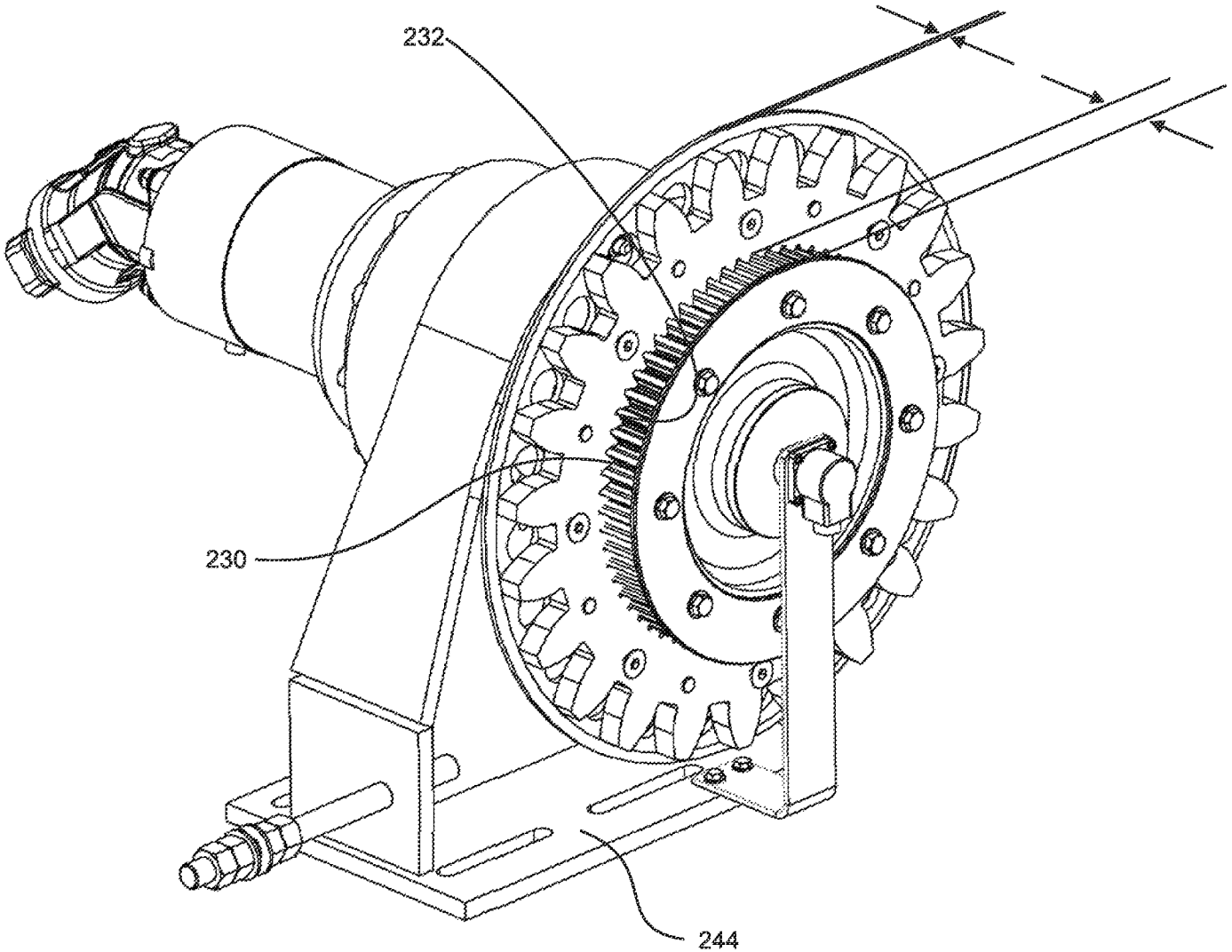
FIG. 11B is a perspective view of the drive gear of FIG. 11A, a side rail shown removed for viewing the gear shifted axially on a splined driveshaft towards the drive itself.
Figure 11C:
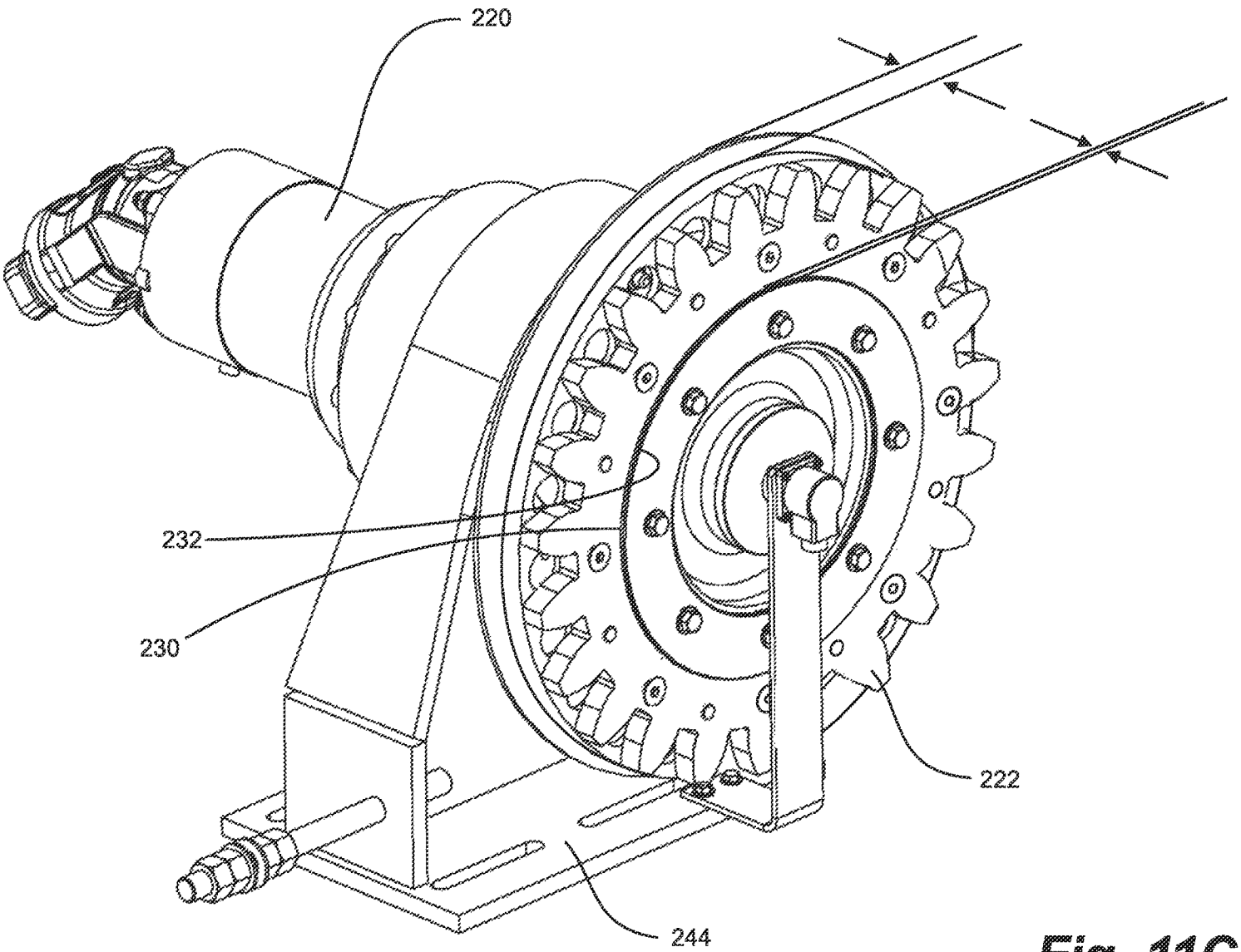
FIG. 11C is a perspective view of the drive gear of FIG. 11B, the gear shifted axially on a splined driveshaft away from the drive.

In one aspect, as shown in FIGS. 11A, 11B and 11C, the drive gear 222 is fit with means for tracking the bull gear 224 or otherwise maintaining continuity of the drive system 202. As shown in FIG. 11A, the drive gear 222 is fit with axially spaced, radially extending side rails 234, 234, straddling the drive gear and hence straddling the bull gear 224 for tracking relative side-to-side movement therebetween, the side rails 234,234 maintaining engagement of the drive gear 222 and bull gear 224, despite flexing of the frame 200 of the CTRU 10. In one embodiment the drive 220 has a splined driveshaft 230. The drive gear 222 is fit with a splined bore 232 (FIG. 11B). The splined bore 232 of gear 222 is axially movable on the splined driveshaft 230. Thus, generally axial relative movement between the drive gear 222 and bull gear 224 are accommodated. Typically, side-to-side movement of the bull gear 224 engages the drive gear's side rails 234 and urges the drive gear 222 to move or shift correspondingly.

Having reference to FIG. 11B the interface of splined bore 232 and driveshaft 230 are illustrated, an outer side rail being omitted for illustrating the stroke of the splined movement. The gear 222 is shown shifted substantially completely towards the drive, or in this embodiment, inboard of the CTRU 10. A shown, the gear 222 can move outboard an amount approximately the same distances as that of the width of the gear 222 itself. With reference to FIG. 11C, when the side rail is present as in operation, the bull gear could have urged the gear 222 outboard to the extent of the splined portion of the driveshaft 230.

Referring to FIG. 10, and the reel 4 and bull gear 224 are manufactured with controlled tolerances to ensure proper engagement of the drive gear 222 and bull gear 224. The bull gear 224 can be manufactured in a plurality of gear sections 240,240 . . . and mounted to backing structure 242 arranged about the periphery of the reel 4. The arcuate sections 240 are each precisely machined and can be assembled, adjusted, and otherwise aligned to form a continuous bull gear on the backing structure 242. A precise gear can thus result on an otherwise less than precise foundation of the bounding flange 210. The reel 4 can be rotated on its axle 204 and any runout minimized through alignment of the sections 240, 240 . . . .

Further, the drive system 202 also accommodates removal of the reel 4 for replacement of spent reels or for maintenance.

Once the CT is spent or fatigued, the reel 4 of CT 2 can be replaced. To enable removal of the reel 4, such as by crane, the drive gear 222 and bull gear 224 need to be separated. Depending on the angle of the gear teeth, the drive 202 and drive gear 222 can be located low in the mobile frame 200, in about a lower quadrant of the reel's circumference, so that the gear teeth of the drive gear 222 and bull gear 224 separate cleanly upon an upward lifting of the reel 4 and axle 204 from the frame 200. The drive 220 and drive system 202 overall, could be difficult to maintain in this configuration. Alternatively, the drive 220 could be generally radially movable from an engaged position, to a disengaged position, releasing the drive from any locational constraints.

Figure 12A:
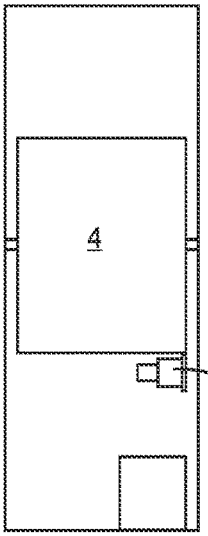
FIGS. 12AT through 12FS are pairs of schematics illustrating a top (T) view and a corresponding side (S) of steps taken to replace a reel on the coiled tubing reel unit of FIG. 9, more particularly.
Figure 12A:
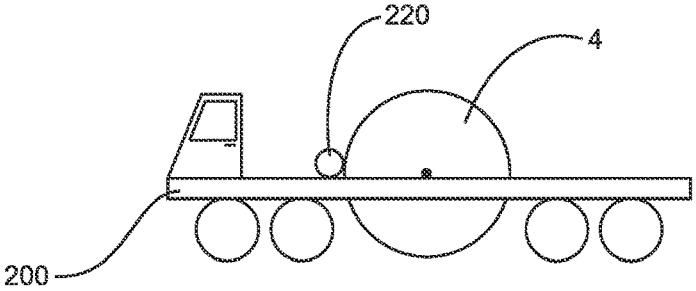

With reference to FIGS. 9, and 12A to 12F, the CRTU 10 is shown in various stages or steps for replacement of a reel 4. In FIGS. 12AT and 12AS the drive 220 and reel 4 are shown in an operational state with the drive gear 222 engaged with the bull gear 224. To enable removal, the drive gear 222 is shifted or displaced generally away from the reel 4. The drive 220 is mounted on a rail mount, slide mount or pivot for disengaging the drive gear 222 from the bull gear 224.

Herein, a form of slide mount 244 is provided for moving the drive generally radially between the engaged and disengaged positions. When the drive mount 244 is secure to the frame 200, the drive gear driveably engages the bull gear. When the drive mount 244 is released, the drive and drive gear are displaced sufficiently to release the reel for replacement. The extent to which the drive must be displaced depends upon the gear meshing and circumferential positioning of the drive about the driven bounding flange.

Accordingly, replacement of a reel 4 is as convenient as replacing a reel cartridge in a "plug-and-play" scenario.

Figure 12B:
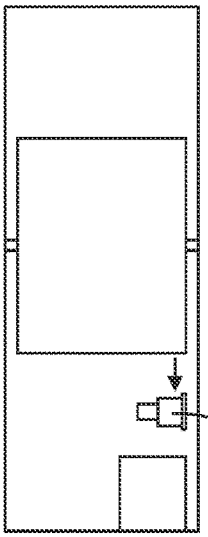
FIGS. 12BT and 12BS are top and side views respectively of the drive and drive gear displaced longitudinally, and radially away from the reel' bull gear.
Figure 12B:
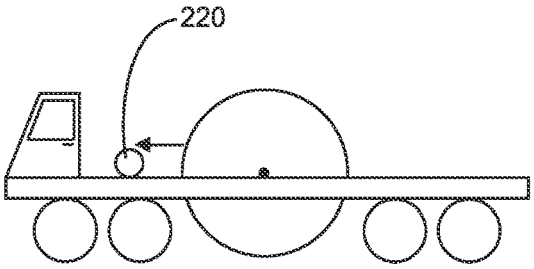
Figure 12C:
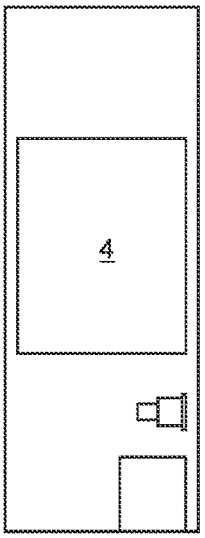
FIGS. 12CT and 12CS are top and side views respectively of reel being removed from the coiled tubing reel unit.
Figure 12C:
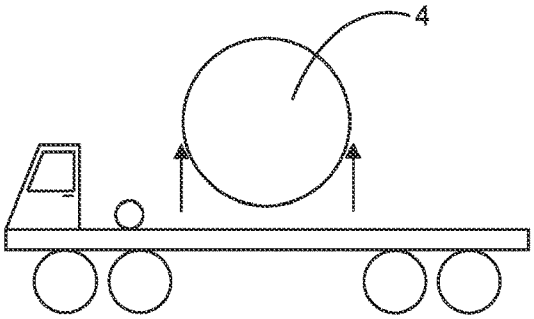

As shown in FIGS. 12BT and 12BS, in one embodiment, the drive 220 is displaced generally radially away from the periphery of the reel 4, disengaging the drive gear 222 from the bull gear 224. Therefore, being free from the drive gear 222, and as shown in FIGS. 12CT and 12CS the reel 4 can be removed from the CTRU 10.

Note that the usual preparation for removal is performed including disconnection of fluid and electrical connections and release of the axle 204 from bearings associated therewith. Removal is improved over the prior art chain drives as chain separation and handling is no longer required.

Figure 12D:
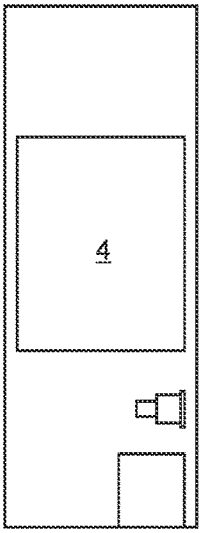
FIGS. 12DT and 12DS are top and side views respectively of a new reel being installed into the coiled tubing reel unit.
Figure 12D:
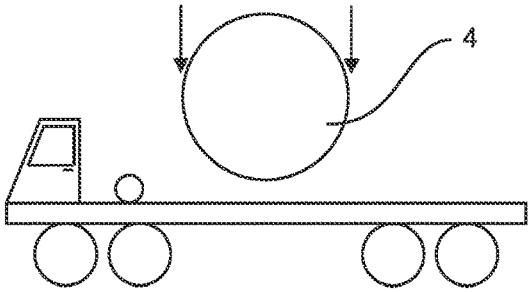
Figure 12E:
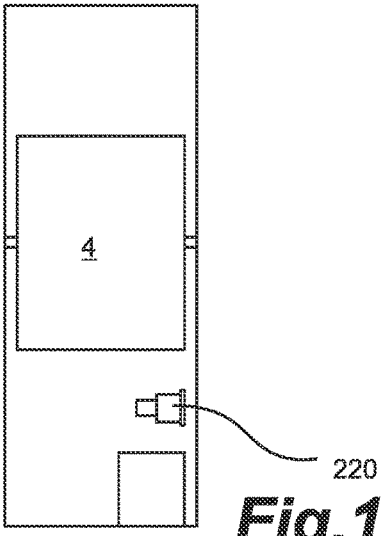
FIGS. 12ET and 12ES are top and side views respectively of the new reel in place in the coiled tubing reel unit.
Figure 12E:
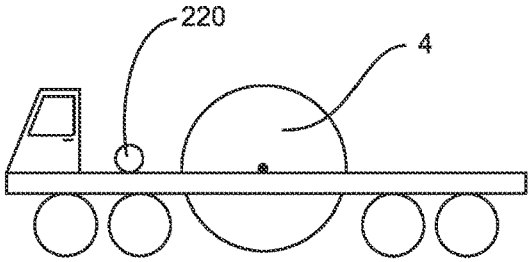

As shown in FIGS. 12DT through 12ES, a replacement reel 4, such as that loaded with usable coiled tubing can then be installed on the CTRU 10.

Figure 12F:
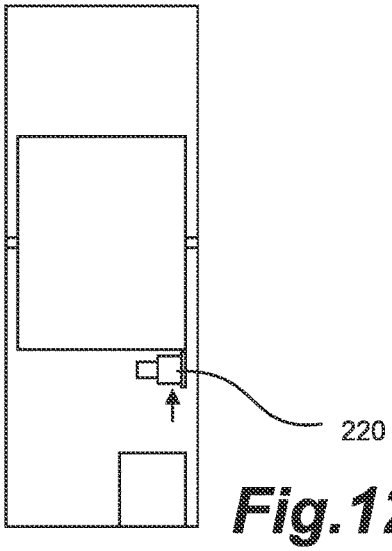
FIGS. 12FT and 12FS are top and side views respectively of the drive and drive gear being returned longitudinally and radially into engagement with the bull gear.
Figure 12F:
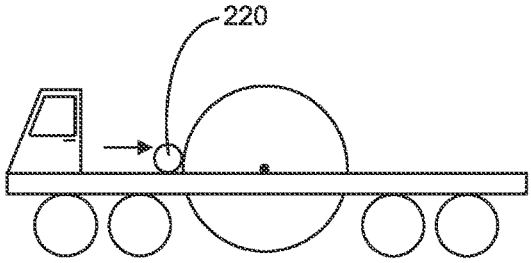

Finally, in FIGS. 12FT and 12FS, the drive 220 can then be displaced toward the reel 4 for engaging the drive gear 222 with the bull gear 224.

It is known to use a reel axis and axle as the drive connection of the CT reel. However, such use has limited the useful diameter of the reel's rotary axle, which is turn has limited the ability to use the axle's bore for auxiliary conduit and control lines. More and more, coiled tubing applications are increasing the numbers and capabilities of auxiliary conduit and control lines down the coiled tubing or as part of a multiline coiled tubing, such as encapsulated coiled tubing or concentric coiled tubing.

Accordingly, and herein, the reel axle 204 has a bore that is free of duties, other than rotational support, and thus the through bore can be made larger in diameter than that of prior art reels. The larger through bore is ideal for accommodating the working end of large diameter encapsulated coiled tubing and enabling use of fluid and electrical controls while running CT 2. Multiline connections at the axis A, extending from the axle bore and that rotate with the reel, are connected through a multiline swivel for on-the-go communication with any downhole tools and bottom hole assemblies.

Figure 13:
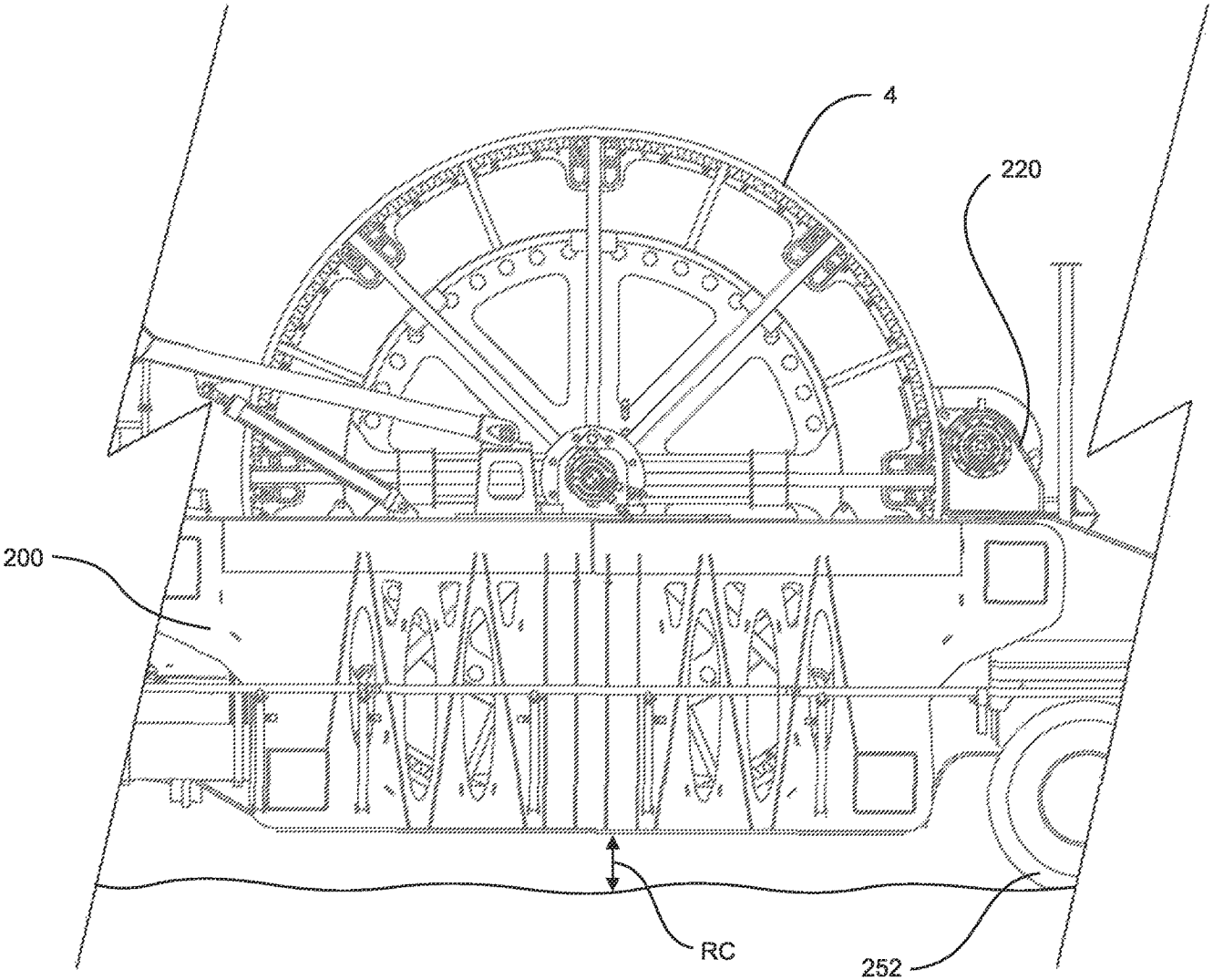
FIG. 13 is a side view of the support structure about the reel in the mobile frame for achieving maximal reel diameter.

Having reference to FIGS. 9 and 13, the CTRU 10 is self-propelled. However, as the reel 4 is inset in frame 200 of the CTRU 10, and the diametral extent being maximized, the reel 4 sits so low therein it nearly reaches the road clearance RC. Thus, the reel 4 can act as a power-transmission barrier between the back and front of the frame 200. Hence, a conventional drive shaft between a front power plant and a rear drive is impractical. Accordingly, a rear power plant 250 or pusher is provided and driveably connected to rear drive wheels 252. The power plant 250 is connected through a drop box or transfer case (not shown) for providing multiple outputs including a drive for the rear wheels 252, and various drives for hydraulics and other auxiliary equipment.

Hydraulics can be routed to the front of the carrier for hydraulic front wheel drive as applicable.

Having reference to FIG. 1A and FIG. 1B, in usual operations, an umbilical (not shown) enables connection to the injector unit 12 and operation of the CTRU 10 reel 14 from the injector unit's control cab 74.

The use of the separate CTRU 10 enables use of "plug-and-play" replacement of spent reels, or adapting for reloading with a reel of coiled tubing on a spooling jig brought on site. Separate reel controls on the CTRU 10 enable reloading using the spooling jig without involvement of the injector unit 12.

Further embodiments claim a rotating gooseneck for a coiled tubing (CT) injector supported on a wellbore side of a mast, comprising:

a rotatable support between the gooseneck and the CT injector;

a proximal segment of the gooseneck connected to the rotatable support, and a distal segment connected to the proximal segment and pivotable between an extended position for forming an arcuate CT guide, and a folded position; and wherein when the gooseneck is in the folded position, the folded gooseneck has effective turning radius that enables rotation clear of the mast.

And a mobile unit for transporting a reel of coil tubing (CT) comprising:

a mobile frame having front and rear wheels and a transport envelope having a height and width substantially that of road transport allowances;

a CT reel fit intermediate the longitudinal extent of the frame between the front and rear wheels and comprising a spool having an axle on a reel axis and bounding flanges, the width between the bounding flange being substantially that of the mobile frame, and the diametral extent being substantially that of the height of the transport envelope; and;

a drive offset radially from the reel axis and engaging at least one of the bounding flange for rotation thereof.

And a drive system for a coiled tubing (CT) reel mobile unit for transporting a reel of coil tubing comprising:

a CT reel comprising a spool having an axle on a reel axis and bounding flanges; and a drive offset radially from the reel axis and engaging at least one of the bounding flange for rotation thereof.

And a method for injecting coiled tubing (CT) in and out of a wellbore, comprising:

positioning a CT injector unit with a back end adjacent a wellbore, an opposing drive end and a longitudinal axis, the CT injector unit having a mast supporting at least a CT injector and a gooseneck.

The embodiments of the invention for which an exclusive property or privilege is claimed are as follows:

1. A system for conveying coiled tubing (CT) into and out of a wellbore comprising:

a first mobile unit having a first mobile frame having a drive end, a back end and a mast supported on the back end adjacent the wellbore, the mast pivotable between a transport position and an erect position;

a CT injector moveable along the mast;

a gooseneck; and a rotatable support between the gooseneck and the injector; and a second mobile unit having a second mobile frame having a CT reel and a reel drive, wherein when the second mobile unit is located at the drive end of the first mobile unit, the gooseneck is rotatable on the rotating support to the drive end to receive CT therefrom, and when the second mobile unit is located at the back end of the first mobile unit, the gooseneck is rotatable on the rotating support to the back end to receive CT therefrom;

wherein the gooseneck includes a proximal segment connected to the rotatable support, and a distal segment connected to the proximal segment and pivotable between an extended position for forming an arcuate CT guide and a folded position, and a fold lock between the proximal segment and the distal segment for retaining the gooseneck in the folded position.

2. The system of claim 1 further comprising a carriage for supporting the CT injector, and wherein the mast further comprises a pair of parallel mast posts connected at the back end and at a crown;

the carriage being supported between the mast posts for moving the injector along the mast.

3. The system of claim 1 wherein the gooseneck further comprises:

an actuator operative between the proximal segment and the distal segment for manipulating the gooseneck between the extended position and the folded position.

4. The system of claim 1, further comprising a rack and pinion system coupled to the CT injector and configured to move the CT injector along the mast.

5. The system of claim 4, wherein the rack and pinion system further comprises a toothed rack that extends along the mast and a drive pinion that engages the toothed rack.

6. The system of claim 1, wherein the mast further comprises a pair of parallel mast posts connected at the back end and at a crown.

7. The system of claim 6, wherein each parallel mast post further comprises:

a first mast section pivotally connected to the back end;

a second mast section, and an extension pivot pivotally connecting the second mast section to the first mast section.

8. The system of claim 7, further comprising a releasable lock between each of the first and second mast sections.

9. The system of claim 8, wherein the releasable lock further comprises:

a latch pin connected to one of the first mast section and the second mast section; and, a lock claw pivotally actuated to engage the latch pin for locking the first mast section to the second mast section.

10. The system of claim 1, further comprising a first tensile member extending between the mast and the back end of the first mobile frame for supporting the mast when the second mobile unit is located at the drive end of the first mobile unit.

11. The system of claim 10, further comprising a second tensile member extending between the mast and the first mobile frame between the drive end and the mast for supporting the mast when the second mobile unit is located at the back end of the first mobile unit.

12. The system of claim 1, further comprising a control cab located on the first mobile frame between the drive end and the back end.

13. A system for conveying coiled tubing (CT) into and out of a wellbore comprising:

a first mobile unit having a first mobile frame having a drive end, a back end and a mast supported on the back end adjacent the wellbore, the mast pivotable between a transport position and an erect position;

a CT injector moveable along the mast, wherein the mast further comprises:

a pair of parallel mast posts connected at the back end and at a crown, wherein each parallel mast post further includes a first mast section pivotally connected to the back end and a second mast section, and an extension pivot pivotally connecting the second mast section to the first mast section;

a releaseable lock between each of the first mast section and the second mast section, wherein the releasable lock includes a latch pin connected to one of the first mast section and the second mast section and a lock claw pivotally actuated to engage the latch pin for locking the first mast section to the second mast section;

an injector frame supporting the CT injector, the injector frame configured to move away from and towards the mast;

a gooseneck; and a rotatable support between the gooseneck and the injector; and a second mobile unit having a second mobile frame having a CT reel and a reel drive, wherein when the second mobile unit is located at the drive end of the first mobile unit, the gooseneck is rotatable on the rotating support to the drive end to receive CT therefrom, and when the second mobile unit is located at the back end of the first mobile unit, the gooseneck is rotatable on the rotating support to the back end to receive CT therefrom.

14. The system of claim 13 wherein the gooseneck includes a proximal segment connected to the rotatable support, and a distal segment connected to the proximal segment and pivotable between an extended position for forming an arcuate CT guide and a folded position;

wherein when the gooseneck is in the folded position the proximal segment is pivotable at a guide pivot on the rotating support.

* * * * *